US011220861B2

(12) United States Patent
Flannery et al.

(10) Patent No.: US 11,220,861 B2
(45) **Date of Patent: *Jan. 11, 2022**

(54) DOUBLE DOOR GATE APPARATUS

(71) Applicant: Carlson Pet Products, Inc., Longboat Key, FL (US)

(72) Inventors: Mark A. Flannery, Longboat Key, FL (US); Elizabeth R. Volk, Saint Paul, MN (US); Brian G. Linehan, Saint Paul, MN (US)

(73) Assignee: Carlson Pet Products, Inc., Longboat Key, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/537,572

(22) Filed: Aug. 10, 2019

(65) Prior Publication Data

US 2019/0360268 A1 Nov. 28, 2019

Related U.S. Application Data

(63) Continuation of application No. 15/881,766, filed on Jan. 27, 2018, now Pat. No. 10,378,277, which is a (Continued)

(51) Int. Cl.
*E06B 11/02* (2006.01)
*E06B 3/52* (2006.01)
(Continued)

(52) U.S. Cl.
CPC ..... *E06B 11/02* (2013.01); *E05C 3/12* (2013.01); *E05C 3/16* (2013.01); *E05D 15/54* (2013.01); *E05F 7/02* (2013.01); *E06B 1/02* (2013.01); *E06B 1/04* (2013.01); *E06B 1/12* (2013.01); *E06B 1/6015* (2013.01); *E06B 3/52* (2013.01); *E06B 3/70* (2013.01); *E06B 7/32* (2013.01); *E06B 9/00* (2013.01); *E06B 9/04* (2013.01);
(Continued)

(58) Field of Classification Search
CPC ..... E06B 11/02; E06B 11/022; E06B 11/027; E06B 3/52; E06B 2009/002; E05F 7/02
See application file for complete search history.

(56) References Cited

U.S. PATENT DOCUMENTS 852,485 A 5/1907 Wroblewski
1,062,971 A 5/1913 Hausmann
(Continued)

FOREIGN PATENT DOCUMENTS

CA 2292034 6/2001
GB 2144470 3/1985

*Primary Examiner* — Marcus Menezes

(57) ABSTRACT

A double door gate apparatus having a frame, a main gate and a secondary gate, where the apparatus includes the unique features of a) a latch apparatus between uppermost framework members of the main gate and secondary gate, b) the latch apparatus being weighted to return to a normally closed position, c) each of the main gate and secondary gates having an inverted U-shaped piece engaging the bottommost horizontal member such that each of the main and secondary gates need to be lifted prior to being opened and prior to being closed, and d) a pair of hand wheels on a common shaft that work together to space the double door gate apparatus a desired distance from a vertical surface such as a wall.

1 Claim, 18 Drawing Sheets

Related U.S. Application Data continuation of application No. 15/201,582, filed on Jul. 4, 2016, now Pat. No. 9,879,453, which is a continuation of application No. 14/634,891, filed on Mar. 1, 2015, now Pat. No. 9,382,750, which is a continuation-in-part of application No. 14/583,044, filed on Dec. 24, 2014, now Pat. No. 9,382,740.

(60) Provisional application No. 61/921,059, filed on Dec. 26, 2013.

(51) Int. Cl.

| | |
|---|---|
| ***E06B 3/70*** | (2006.01) |
| ***E06B 1/02*** | (2006.01) |
| ***E06B 1/04*** | (2006.01) |
| ***E05C 3/16*** | (2006.01) |
| ***E06B 7/32*** | (2006.01) |
| ***E06B 9/04*** | (2006.01) |
| ***E05D 15/54*** | (2006.01) |
| ***E05F 7/02*** | (2006.01) |
| ***E06B 9/00*** | (2006.01) |
| ***E05C 3/12*** | (2006.01) |
| ***E06B 1/12*** | (2006.01) |
| ***E06B 1/60*** | (2006.01) |
| *E06B 9/01* | (2006.01) |

(52) U.S. Cl.

CPC ..... *E06B 11/022* (2013.01); *E06B 11/027* (2013.01); *E06B 2003/7046* (2013.01); *E06B 2003/7096* (2013.01); *E06B 2009/002* (2013.01); *E06B 2009/015* (2013.01)

(56) References Cited

U.S. PATENT DOCUMENTS

| | | | | |
|---|---|---|---|---|
| 1,451,172 | A | 4/1923 | Mayer | |
| 1,621,828 | A | 3/1927 | Canny | |
| 1,787,249 | A | 12/1930 | Heinz | |
| RE19,617 | E | 6/1935 | Dresser | |
| 2,149,607 | A | 3/1939 | Keiser | |
| 3,180,667 | A | 4/1965 | Max | |
| 3,233,932 | A | 2/1966 | Uttterback | |
| 3,684,336 | A | 8/1972 | Mathys | |
| 3,918,203 | A | 11/1975 | Ellison, Jr. | |
| 5,361,538 | A | 11/1994 | McNabb | |
| 6,056,038 | A | 5/2000 | Foster | |
| 6,691,457 | B2 | 2/2004 | Hincher, Sr. | |
| 7,131,235 | B2 * | 11/2006 | Hicks | E06B 9/04 49/55 |
| 7,887,029 | B2 | 2/2011 | Flannery | |
| 7,950,184 | B2 * | 5/2011 | Flannery | E06B 9/04 49/57 |
| 7,975,431 | B2 * | 7/2011 | Flannery | E06B 9/04 |
| 8,196,348 | B2 | 6/2012 | Flannery | |
| 8,341,886 | B2 * | 1/2013 | Yates | E06B 9/04 49/55 |
| 8,448,381 | B2 | 5/2013 | Flannery | |
| 9,382,740 | B2 | 7/2016 | Flannery | |
| 9,382,750 | B1 | 7/2016 | Flannery | |
| 2004/0045222 | A1 * | 3/2004 | Hicks | E05F 1/066 49/394 |
| 2006/0207180 | A1 | 9/2006 | Cheng | |
| 2007/0074453 | A1 | 4/2007 | Flannery | |
| 2008/0265233 | A1 | 10/2008 | Flannery | |
| 2009/0293363 | A1 * | 12/2009 | Flannery | E06B 9/04 49/55 |
| 2011/0225890 | A1 | 9/2011 | Greenwood | |
| 2013/0160365 | A1 * | 6/2013 | Flannery | E05C 1/10 49/50 |
| 2013/0221305 | A1 * | 8/2013 | Dilworth | A01K 3/002 256/73 |
| 2015/0089873 | A1 * | 4/2015 | Marsden | E06B 9/02 49/56 |

* cited by examiner

DOUBLE DOOR GATE APPARATUS

This application is a continuation, and claims the benefit under 35 U.S.C. § 120, of U.S. Nonprovisional patent application Ser. No. 15/881,766 filed Jan. 27, 2018, which was a continuation, and claims the benefit under 35 U.S.C. § 120, of U.S. Nonprovisional patent application Ser. No. 15/201,592 filed Jul. 4, 2016, which was a continuation, and claims the benefit under 35 U.S.C. § 120, of U.S. Nonprovisional patent application Ser. No. 14/634,891 filed Mar. 1, 2015, which was a continuation-in-part, and claims the benefit under 35 U.S.C. § 120, of U.S. Nonprovisional patent application Ser. No. 14/583,044 filed Dec. 24, 2014, which claims the benefit under 35 U.S.C. 119(e) of U.S. Provisional Patent Application No. 61/921,059 filed Dec. 26, 2013, all of which applications are hereby incorporated by reference in their entireties into this application.

FIELD OF THE INVENTION

The present invention relates generally to a gate having two doors, more particularly to such a gate where the outer ends of the doors are pivotally mounted and where the inner ends of the doors confront each other and swing, and specifically to such a gate where the inner ends of the doors are engagable to each other and where the doors are lifted vertically prior to being opened.

BACKGROUND OF THE INVENTION

"Twin" is a word that may describe two people, such as identical twins or fraternal twins. Of course, "twin" does not necessarily mean "identical twin." For example, "twin" is a word that may describe two things adjacent to each other, such as cities. The Twin Cities are separated only by the Mississippi River.

The term "twin" is well known. What is less well known is the term for a non-twin or a person without a twin. This term is "singleton." Most people are singletons.

The vast majority of home or residential gates, for use inside or outside of the home, are singleton gates. That is, most gates do not have a twin. While French doors may be found in residential homes, twin gates for home residential use may be a new paradigm.

SUMMARY OF THE INVENTION

A feature of the present invention is a double door gate apparatus.

Another feature of the present invention is the provision in a double door gate apparatus, of a main gate having an outer and inner end, of a secondary gate having an outer and inner end, where the outer ends of the main and secondary gates are pivotally mounted to a frame, and where the inner ends of the main and secondary gates confront each other and swing to open and close the gates.

Another feature of the present invention is the provision in a double door gate apparatus, of a frame having a first vertical member, a second vertical member, where the first and second vertical members are spaced apart, where each of the first and second vertical members have an upper end and a lower end, and of the frame further having a first horizontal member, a second horizontal member, and a third horizontal member, where the first horizontal member is on the upper end of the first vertical member and extends inwardly, where the second horizontal member is on the upper end of the second vertical member and extends inwardly, and where the third horizontal member is engaged to each of the lower ends of the first and second vertical members.

Another feature of the present invention is the provision in a double door gate apparatus, of a main gate having an outer end and an inner end, where the outer end of the main gate is mounted on a first pivot axis between the first horizontal member and the third horizontal member, where the inner end of the main gate is swingable across the third horizontal member, and where the main gate is slideable vertically up and down on the first pivot axis.

Another feature of the present invention is the provision in a double door gate apparatus, of a secondary gate having an outer end and an inner end, where the outer end of the secondary gate is mounted on a second pivot axis between the second horizontal member and the third horizontal member, where the inner end of the secondary gate is swingable across the third horizontal member, and where the secondary gate is slideable vertically up and down on the first pivot axis.

Another feature of the present invention is the provision in a double door gate apparatus, of the first and third horizontal members working as stops to limit vertical sliding of the main gate on the first pivot axis.

Another feature of the present invention is the provision in a double door gate apparatus, of the second and third horizontal members working as stops to limit vertical sliding of the secondary gate on the second pivot axis.

Another feature of the present invention is the provision in a double door gate apparatus, of the main gate being engagable to and disengagable from the secondary gate.

Another feature of the present invention is the provision in a double door gate apparatus, of the main gate being engagable to and disengagable from the third horizontal member.

Another feature of the present invention is the provision in a double door gate apparatus, of the secondary gate being engagable to and disengagable from the third horizontal member.

Another feature of the present invention is the provision in a double door gate apparatus, of the inner end of the main gate being engagable to the inner end of the secondary gate.

Another feature of the present invention is the provision in a double door gate apparatus, of the inner end of the main gate being engagable to the third horizontal member.

Another feature of the present invention is the provision in a double door gate apparatus, of the inner end of the secondary gate being engagable to the third horizontal member.

Another feature of the present invention is the provision in a double door gate apparatus, of the outer end of the secondary gate being engagable to the second horizontal member.

Another feature of the present invention is the provision in a double door gate apparatus, of a main gate having an outer end and an inner end, where the outer end of the main gate is mounted to the frame on a first pivot axis, where the inner end of the main gate is swingable to open and close the main gate relative to the frame, and where the main gate is slideable vertically up and down on the first pivot axis.

Another feature of the present invention is the provision in a double door gate apparatus, of a secondary gate having an outer end and an inner end, where the outer end of the secondary gate is mounted to the frame on a second pivot axis, where the inner end of the secondary gate is swingable to open and close the secondary gate relative to the frame, where the inner end of the secondary gate confronts the inner end of the main gate when the main and secondary gates are in a closed position, and where the secondary gate is slideable vertically up and down on the first pivot axis.

Another feature of the present invention is the provision in a double door gate apparatus, of the combination of the inner end of the main gate being engagable to and disengagable from the inner end of the secondary gate, the inner end of the main gate being engagable to and disengagable from the frame, and the inner end of the secondary gate being engagable to and disengagable from the frame.

Another feature of the present invention is the provision in a double door gate apparatus, of the combination of the inner end of the main gate being engagable to and disengagable from the inner end of the secondary gate, the inner end of the main gate being engagable to and disengagable from the frame, the inner end of the secondary gate being engagable to and disengagable from the frame, and the outer end of the secondary gate being engagable to and disengagable from the frame.

Another feature of the present invention is the provision in a double door gate apparatus, of the frame including upper and lower portions working as stops to limit vertical sliding of the main gate on the first pivot axis.

Another feature of the present invention is the provision in a double door gate apparatus, of the frame including upper and lower portions working as stops to limit vertical sliding of the secondary gate on the first pivot axis.

Another feature of the present invention is the provision in a double door gate apparatus, of the main gate being openable relative to the frame independently of the secondary gate such that the main gate is swingable relative to the frame at a time when the secondary gate is fixed in a closed position to the frame.

Another feature of the present invention is the provision in a double door gate apparatus, of the secondary gate being openable relative to the frame independently of the main gate such that the secondary gate is swingable relative to the frame at a time when the main gate is fixed in a closed position to the frame.

Another feature of the present invention is the provision in a double door gate apparatus, of the main gate being openable relative to the frame at a time when the secondary gate is openable relative to the frame such that the main gate and secondary gate are concurrently swingable relative to the frame.

Another feature of the present invention is the provision in a double door gate apparatus, of the main gate being required to be disengaged from the secondary gate and lifted vertically along the first pivot axis prior to opening the main gate relative to the frame.

Another feature of the present invention is the provision in a double door gate apparatus, of the secondary gate being required to be disengaged from the main gate and lifted vertically along the second pivot axis prior to opening the secondary gate relative to the frame.

Another feature of the present invention is the provision in a double door gate apparatus, of the main gate and secondary gate being liftable along the first and second pivot axes and engagable to each other concurrently.

Another feature of the present invention is the provision in a double door gate apparatus, of the inner end of the main gate that is engagable to and disengagable from the inner end of the secondary gate including an upper inner end, and of the inner end of the main gate that is engagable to and disengagable from the frame including a lower inner end.

Another feature of the present invention is the provision in a double door gate apparatus, of the inner end of the secondary gate that is engagable to and disengagable from the frame including a lower inner end, and of the outer end of the secondary gate that is engagable to and disengagable from the frame including an upper outer end.

Another feature of the present invention is the provision in a double door gate apparatus, of the main gate being swingable in either of the clockwise or counterclockwise directions and of the secondary gate being swingable in either of the clockwise or counterclockwise directions.

Another feature of the present invention is the provision in a double door gate apparatus, of first and second shafts and first and second hand wheels, where the first hand wheel is turnable on the first shaft, where the second hand wheel is turnable on the second shaft, where the first shaft is engaged to the frame and the first hand wheel brings pressure bear on the first vertical support member when the first hand wheel is turned, where the second shaft is engaged to the frame and the second hand wheel brings pressure to bear on the second vertical support member when the second hand wheel is turned to secure the double door gate apparatus at a location relative to an environment.

Another feature of the present invention is the provision in a double door gate apparatus, of the frame being an open top frame such that no horizontal support members extend from the first vertical support member to the second vertical support member other than the horizontal support member over which the main and secondary gates swing.

Another feature of the present invention is the provision in a double door gate apparatus, of a latch apparatus between the main gate and the secondary gate, the latch apparatus having a length direction, a width direction and a height direction.

Another feature of the present invention is the provision in a double door gate apparatus, of a body, the body extending from the main gate to the secondary gate, the body being fixed to one of the main and secondary gates, the body being releasably engaged to the other of the main and secondary gates, the body having a first face and a second face.

Another feature of the present invention is the provision in a double door gate apparatus, of a swinging piece, the swinging piece being swingably engaged to the body, the swinging piece having a first end and a second end, the first end of the swinging piece being adjacent to the first face of the body, the second end of the swinging piece being adjacent to the second end of the body, the second end being swingable in response to a force being applied to the first end, the first end being swingable in response to a force being applied to the second end.

Another feature of the present invention is the provision in a double door gate apparatus, of an extension, the extension fixed to and extending from the other of main and secondary gates to which the body is fixed to, the extension having first and second surfaces and a distal end, the extension being receivable in the body.

Another feature of the present invention is the provision in a double door gate apparatus, of the swinging piece having an open and away position and a closed confronting position relative to the extension, the second end of the swinging piece confronting the first surface of the extension when the swinging piece is in the closed confronting position and in which said closed confronting position the body cannot be releasably engaged from said other of the main and secondary gates, the second end of the swinging piece swingable beyond the distal end of the extension and in which said open and away position the body can be releasably engaged from said other of the main and secondary gates to open the latch apparatus.

Another feature of the present invention is the provision in a double door gate apparatus, of the swinging piece surrounding the body when the swinging piece is in the open and closed positions.

Another feature of the present invention is the provision in a double door gate apparatus, of the swinging piece surrounding the body and the extension when the swinging piece is in the closed position.

Another feature of the present invention is the provision in a double door gate apparatus, of the body extending through the swinging piece.

Another feature of the present invention is the provision in a double door gate apparatus, of the extension extending through the swinging piece when the swinging piece is in the closed position.

Another feature of the present invention is the provision in a double door gate apparatus, of the swinging piece swinging about a pivot, a first portion of the swinging piece being defined as a portion running from the pivot to the first end, a second portion of the swinging piece being defined as a portion running from the pivot to the second end, the second portion of the swinging piece having a weight greater than a weight of the first portion of the swinging piece such that the second portion of the swinging piece is normally disposed at a lower elevation than the first portion of the swinging piece.

Another feature of the present invention is the provision in a double door gate apparatus, of the first surface of the extension being a keeper surface to keep the latch apparatus locked when the swinging piece is in the closed position, the pivot having a pivot axis, the pivot axis and second end of the swinging piece defining a plane, the plane intersecting the first surface when the swinging piece is in a closed position.

Another feature of the present invention is the provision in a double door gate apparatus, of the second surface of the extension being a striker inclined surface for the second end of the swinging piece, the second surface having a proximal end at a first elevation and a distal end at a second elevation, the first elevation being greater than the second elevation such that the second end of the swinging piece can strike the second surface and slide down the second surface.

Another feature of the present invention is the provision in a double door gate apparatus, of the body being U-shaped and receiving a first section of the first object and a first section of the second object.

Another feature of the present invention is the provision in a double door gate apparatus, of the swinging piece including first and second following arms, the first and second following arms extending over exterior surface of the body, each of the first and second following arms having a distal end, the first and second following arms being spaced apart, and wherein the second end of the swinging piece comprises a roller, the roller being rotatably engaged between the distal ends of the first and second following arms.

Another feature of the present invention is the provision in a double door gate apparatus, of the swinging piece including first and second actuating arms, the first and second actuating arms extending over exterior surfaces of the body, each of the first and second actuating arms having a distal end, the first and second actuating arms being spaced apart, and wherein the first end of the swinging piece comprises a cross piece fixed between the distal ends of the first and second actuating arms and accessible to a user of the double door gate apparatus such that the user may press or pull the cross piece to initiate a swinging of the swinging piece.

Another feature of the present invention is the provision in a double door gate apparatus, of the main gate being slideable vertically up and down on the first pivot axis, where the secondary gate is slideable vertically up and down on the second pivot axis, where the main gate is engagable to and disengagable from the horizontal support member of the frame such that the main gate is openable and closeable relative to the horizontal support member of the frame, where the secondary gate is engagable to and disengagable from the horizontal support member of the frame such that the secondary gate is openable and closeable relative to the horizontal support member of the frame, where, prior to swinging the main gate relative to the frame from the closed position, the main gate must be lifted vertically along the first pivot axis to be disengaged from the horizontal support member of the frame, where, prior to swinging the secondary gate relative to the frame from the closed position, the secondary gate must be lifted vertically along the second pivot axis to be disengaged from the horizontal support member of the frame, where, when swinging the main gate in a lowermost position from an open position back toward the closed position and back toward an engagement with the horizontal frame member of the frame, the main gate must be lifted and then must be lowered to establish the closed position and engage the main gate to the horizontal support member of the frame, and where, when swinging the secondary gate in a lowermost position from an open position back toward the closed position and back toward an engagement with the horizontal frame member of the frame, the secondary gate must be lifted and then must be lowered to establish the closed position and engage the secondary gate to the horizontal support member of the frame.

Another feature of the present invention is the provision in a double door gate apparatus, of the main gate including front and rear plate sections depending from the main gate and confronting front and rear faces of the horizontal support member of the frame in the closed position such that the main gate must be lifted vertically from the closed position prior to swinging the main gate relative to the frame, and of the secondary gate including front and rear plate sections depending from the secondary gate and confronting front and rear faces of the horizontal support member of the frame in the closed position such that the secondary gate must be lifted vertically from the closed position prior to swinging the secondary gate relative to the frame.

Another feature of the present invention is the provision in a double door gate apparatus, of the main gate having a main gate framework, the main gate framework including an uppermost support member, of the secondary gate having a secondary gate framework, the secondary gate frame work including an uppermost support member and of a latch apparatus between the uppermost support members of the main gate framework and the secondary gate framework.

Another feature of the present invention is the provision in a double door gate apparatus, of the uppermost support member of the main gate framework including an integral portion being disposed at a greater elevation than any other portion of the main gate framework and of the uppermost support member of the secondary gate framework including an integral portion being disposed at a greater elevation than any other portion of the secondary gate framework.

Another feature of the present invention is the provision in a double door gate apparatus, of an end vertical support member, the end vertical support member fixed to a portion of an environment of the double door gate apparatus, the end vertical support member being spaced from the frame of the double door apparatus.

Another feature of the present invention is the provision in a double door gate apparatus, of the frame of the double door gate apparatus having a horizontal tube.

Another feature of the present invention is the provision in a double door gate apparatus, of a threaded horizontal shaft, the threaded horizontal shaft extending between the end vertical support member and the horizontal tube, the threaded horizontal shaft rotatably engaged to the end vertical support member, the threaded horizontal shaft at least partially extending into the horizontal tube.

Another feature of the present invention is the provision in a double door gate apparatus, of a first hand wheel fixedly engaged on the threaded horizontal shaft and confronting the end vertical support member such that, when the first hand wheel is spun, the threaded horizontal shaft is spun.

Another feature of the present invention is the provision in a double door gate apparatus, of a second hand wheel engaged on the threaded horizontal shaft such that the second hand wheel travels axially on the threaded horizontal shaft when spun on the threaded horizontal shaft, the second hand wheel confrontable with the horizontal tube to space the horizontal tube and thus double door gate apparatus as a whole a desired distance from the end vertical support member.

An advantage of the present invention is that a gate opening of a given length is regulated by two gates instead of one. Each of the gates thus is shorter than one long gate. A shorter gate is less massive and easier to open than a larger gate.

Another advantage of the present invention is that the direction of ingress and egress may be regulated. For example, a swinging gate by its very nature restricts access to a particular area even when the gate is swung open. This particular area is the territory behind the gate, whether the gate is open or whether the gate is shut. If the gate is open, one must walk around the far end of the gate to get to the territory behind the gate. This territory changes as the gate is swung. In other words, let us say a first gate is like the hour hand of a clock and has a pivoting end at the center of the clock. Let us further say that the first gate is part of a fence and that the fence runs from the 9 o'clock location to the center of the clock and that the first gate runs from the center of the clock to the 3 o'clock location. Then, if the gate is swung open to the 6 o'clock location, the gate allows access to the 4 o'clock and 5 o'clock locations, but the gate still restricts direct access to the 7 o'clock and 8 o'clock locations. A person may walk around the swinging end of the first gate to get to the 7 o'clock and 8 o'clock locations, but this may be regarded as inconvenient. If, however, a second gate is placed to the right of the clock as one looks at the clock, access to the 7 o'clock and 8 o'clock locations may be had directly where the swinging end of the second gate confronts the swinging end of the first gate at the 3 o'clock location, and where the second gate is in line with the first gate. In this example, the first gate is swung clockwise to open and the second gate is swung counterclockwise to open. In this example, to access the 7 o'clock and 8 o'clock locations, the first gate remains closed and the second gate is swung open, thereby permitting the user to walk directly to the 7 o'clock and 8 o'clock locations. This advantage applies to twin gates that are identical in length or have different lengths.

Another advantage of the present twin gate over a singleton gate is that the size of the gate opening itself may be regulated. In other words, a twin gate may have three openings, all of different sizes. For example, the twin gates may be fraternal, not identical, such that the twin gates have different lengths. For instance, in this example, the first gate may be longer than the second gate. In this example, when each of the first and second gates are opened, the size of the gate opening is large—the largest possible in this example. When only the first gate is open, the size of the gate opening is lesser in length than where both gates are open, but greater in length than when the second gate is open. When only the second gate is open, the size of the gate opening is lesser in length than when the only the first gate is opening. Tables and chairs may need to be carried into a fenced off area; here each of the first and second gates may be opened. Perhaps only adults may be entering into a fenced off area; here only the first gate needs to be opened. Perhaps only children may be entering into a fenced off area; here only the second gate needs to be opened. In sum, the size of the gate opening increases from 1) when only the second gate is open, to 2) when only the first gate is open, to 3) when each of the first and second gates are open. The first gate may be referred to as the main gate. The second gate may be referred to as the secondary gate.

Another advantage of having twin gates is that the gates may be selected to be identical to each other or be different (fraternal) from each other. For example, identical gates that oppose each other and have swinging ends confronting each other, may be manufactured in the same way and may be installed in the same way. Or a home owner may decide to install twin gates where each of the gates has one or more features that are different from the other gate. These differences include different lengths, different internal supports such as posts or wire mesh, different aesthetics, different materials—one gate being formed of wood and the other gate being formed of metal, different heights where, for example, the different heights fit with the aesthetics or functionality of the backyard, and further differences not set out here.

Another advantage of the present invention is that each of the gates requires a process to open and, therefore, minimizes the operation thereof by younger children. Each of the gates requires at least a two-step process to open: an unlatching of a latch and then a lifting of the gate itself. The secondary gate may be set up to require a two-step process or a three step process, where the three step process is the swinging away of a stop, then the unlatching of a latch, and then a lifting of the secondary gate. Such a three step process on the secondary gate may be reduced to a two-step process by keeping the stop at all times swung away.

Another advantage of the present invention is that each of the twin gates acts as a support for the opposing gate. That is, while each of the gates opens and swings, each of the gates can also be fixed in place to operate as a fixed support for the other gate. The secondary gate is especially sturdy as a support with, first, a saddle engaging a bottom cross support to prevent swinging, and with, second, a stop when swung into place preventing vertical lifting of the secondary gate.

Another advantage of the present invention is that each of the gates is easy to open and easy to close for older children and adults. For example, depending upon the height of the gate, each of the gates may be operated at hand level. The horizontal latch between the main and secondary gates is at an upper portion of the main gate and the swinging stop is at an upper portion of the secondary gate. Then, after one or more of the latch and stop are operated, the hands take portions of the frame that are at hand level and adjacent to the latch and stop to lift up and swing one or more of the main and secondary gates. No bending, stooping or squatting is required to operate the main and secondary gates.

Another advantage of the present invention is that the secondary gate can be configured to require two steps to open even if the horizontal latch thereto is unlatched. To configure such, the stop is swung to an operating position to prevent a lifting action of the gate. Thus, after being configured in such a manner, the secondary gate is only opened by swinging the stop away and lifting the secondary gate, whereupon the secondary gate may be swung.

Another advantage of the present invention is that the main gate may be automatically shut. That is, lifting is not required for a full closure of the main gate.

Another advantage of the present invention is that the twin gates have a minimum of moving parts. The horizontal sliding latch between the main and secondary gates is a moving part. The swinging stop that prevents lifting of the secondary gate is a moving part. The vertical sliding latch between the main gate and the lower horizontal cross member is a sliding part. Not counting the main and secondary gates themselves, each of which as a whole swings, the double door gate apparatus has only three moving parts.

Another advantage of the present invention is that, after being lifted, the double door gate apparatus includes sturdy frame portions that stop the lifting of the main and secondary gates. These frame portions extend inwardly from vertical posts on either end of the main and secondary gates.

Another advantage of the present invention is that the weighted latch apparatus returns by gravity to the normal locked or closed position when the user lets go of the latch apparatus.

Another advantage of the present invention is that the weighted latch apparatus has a minimum number of parts. Since the weighted latch apparatus returns by gravity to a normal closed position, there is no need for parts such as springs and retainers for springs.

Another advantage of the present invention is that the weighted latch apparatus is positioned so as to be maximally accessible to an adult operating the double door gate apparatus and minimally accessible to a toddler or small child trying to operate the double door gate apparatus. One feature contributing to this advantage is that the weighted latch apparatus is positioned on an uppermost support member of the main gate framework and on an uppermost support member of the secondary gate framework.

Another advantage of the present invention is that the double door gate apparatus is easy to position between two opposing environmental surfaces such as walls. One feature contributing to this advantage is relationship of the first and second hand wheels to the threaded horizontal shaft that extends between one wall and the double door gate apparatus, where a first hand wheel is fixed engaged to the threaded horizontal shaft such that the threaded horizontal shaft may be held still against rotation, and where the second hand wheel is spinnable axially on the horizontal threaded shaft and confrontable against a horizontal threaded tube of the double door gate apparatus.

Another advantage of the present invention is that each of the main gate and secondary gates is sturdy and strong in their closed positions. One feature contributing to this advantage is that each of the main and secondary gates has a front and rear plate section confronting the bottommost support member extending between the main and secondary gates so as to provide a wide surface area of abutment between the plate sections and their respective confronting sections of the bottommost horizontal support member.

DESCRIPTION

Figure 1:
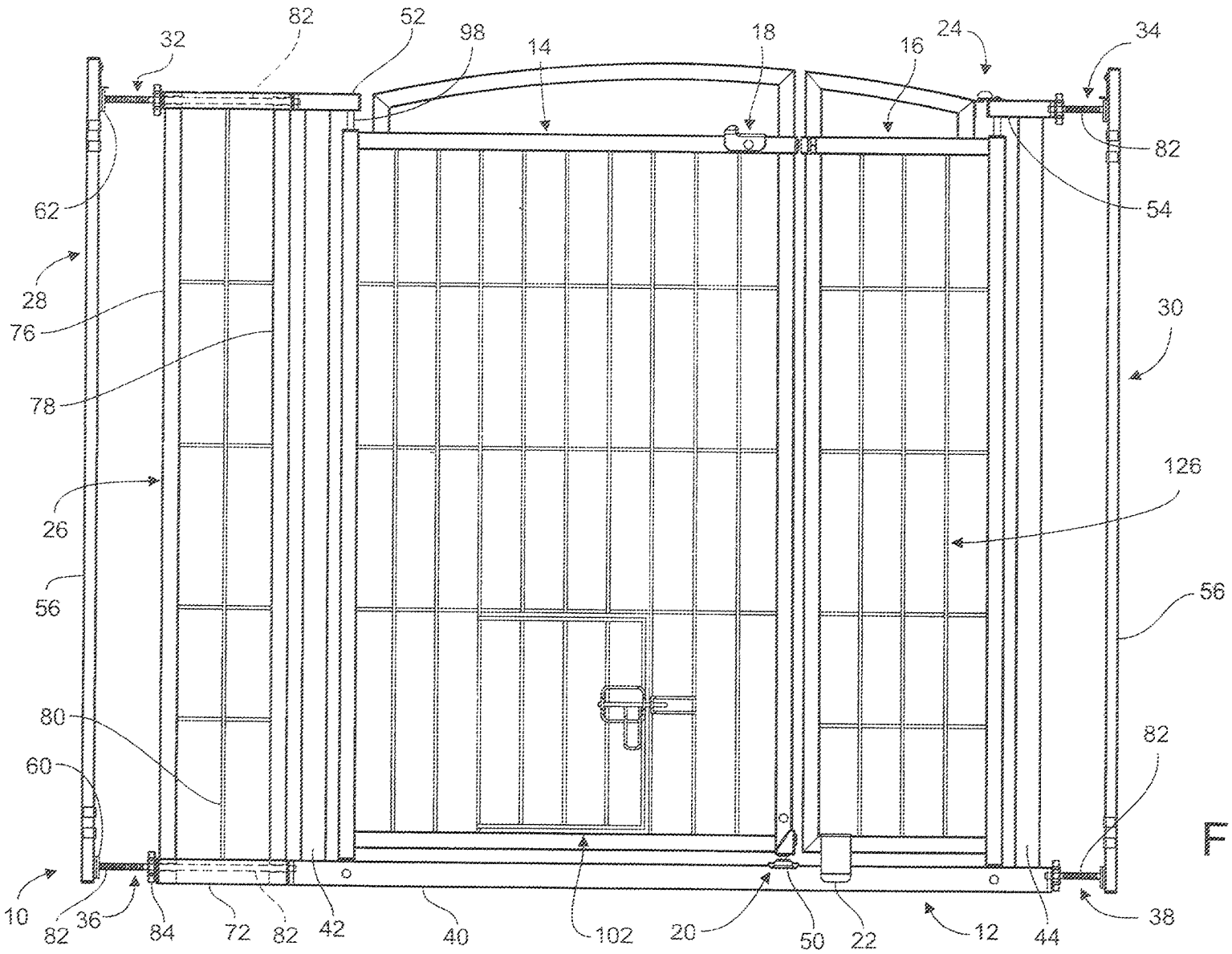
FIG. 1 shows a front view of the double door gate apparatus of the present invention where the swinging ends of a main gate and secondary gate are engaged to each other and further engaged to a frame of the double door gate apparatus, and where the main and secondary gates are in a rest position.

As shown in FIG. 1, the present double door gate apparatus is indicated in general by the reference numeral 10. Double door gate apparatus 10 includes a generally U-shaped frame 12, a main gate 14, a secondary gate 16, a latch mechanism 18 between the main and secondary gates 14, 16, a latch mechanism 20 between the main gate 14 and the frame 12, a saddle 22 between the secondary gate 16 and the frame 12, and a swinging stop mechanism 24 between the secondary gate 16 and the frame 12.

Double door gate apparatus 20 further includes a gate extension 26, a first vertical base 28, a second vertical base 30, a first upper horizontal support and adjustment member 32, a second upper horizontal support and adjustment member 34, a first lower horizontal support and adjustment member 36, and a second lower horizontal support and adjustment member 38.

The U-shaped frame 12 includes a lower horizontal support member 40, a first upright vertical support member 42, a second upright vertical support member 44, a first upper horizontal support member or stop 46, and a second upper horizontal support member or stop 48. Members 40, 42, 44, 46 and 48 are rigidly fixed to one another such as by welding. Members 40, 42, 44, 46 and 48 may be one-piece and integral. One or more of the members 40, 42, 44, 46 and 48 may be tubular. Preferably each of the members 40, 42, 44, 46 and 48 are tubular. Frame 12 may be a metal frame where one or more of members 40, 42, 44, 46 and 48 are formed of a metal such as stainless steel or aluminum.

Lower horizontal support member 40 is a base member and a cross support member. Member 40 may be square in section. Member 40 may be rectangular in section so as to have a relatively low profile. Gates 14, 16 swing in both directions across member 40 and people walk over member 40. If desired, member 40 may be a flat bar or strip to provide even a lower profile to minimize feet hitting the member 40 as people walk through the gates 14, 16. Member 40 has a length greater than the combined width of the main and secondary gates 14, 16.

Lower horizontal member 40 mounts a latch receptor 50 of the latch apparatus 20. Lower horizontal member 40 is engaged by saddle 22 on each of the vertically extending side surfaces of the lower horizontal member 40. Lower horizontal member 40 is further engaged by first lower support and adjustment member 36 and second lower support and adjustment member 38. Lower horizontal member 40 abuts a surface on its underside, where the surface may be concrete, wood, asphalt, dirt, grass, gravel or tile. Such surface may be an indoor surface or an outdoor surface.

Double door gate apparatus 10 is not a pressure gate apparatus. Frame 12 is not a pressure frame where the vertical supports 42, 44 are manufactured such that one is slightly oblique relative to member 40 such that, upon pressure induced by one or more of the support and adjustment members 32, 34, 36, 38, inner ends of the gates 14, 16 are brought together.

Each of the vertical members 42, 44 extends at right angle to lower horizontal member 40. Each of the vertical members 42, 44 is joined to an end portion of the lower horizontal member 40 and to a top surface portion of the lower horizontal member 40. Each of the vertical members 42, 44 is offset slightly from an absolute end of horizontal member 40. Each of the vertical members 42, 44 is square in section and is tubular. Each of the vertical members 42, 44 may be about the height of each of the main and secondary gates 14, 16. Vertical member 42 is spaced from the outer end of main gate 14 and vertical member 44 is spaced from the outer end of secondary gate 16. The distance between the inner sides of the vertical support members 42, 44 is greater than the combined width of the main and secondary gates 14, 16. The distance between the outer sides of the vertical support members 42, 44 is less than the length of horizontal support member 40.

Upper horizontal support member 46 is mounted at the top end of vertical support member 42, such as by welding. Support member 46 is square in section and is tubular. A portion of support member 46 extends outwardly away from the main gate 14 to receive and engage the first upper support and adjustment member 32. A stop portion 52 of support member 46 extends inwardly toward main gate 14. This inwardly directed stop portion 52 limits the vertical travel or vertical sliding of the main gate 14 along its vertical axis. Main gate 14 is lifted along this vertical axis to disengage the latch mechanism 20. A post of the main gate 14 hits the underside of stop portion 52 to stop the vertical lifting of main gate 14.

Upper horizontal support member 48 is mounted at the top end of vertical support member 44, such as by welding. Support member 48 is square in section and is tubular. A portion of support member 48 extends outwardly away from the secondary gate 16 to receive and engage the second upper support and adjustment member 34. A stop portion 54 of support member 48 extends inwardly toward secondary gate 16. This inwardly directed stop portion 54 limits the vertical travel or vertical sliding of the secondary gate 16 along its vertical axis. After swinging stop mechanism 24 is swung away, secondary gate 16 may be lifted along this vertical axis to disengage the saddle 22 from the lower horizontal member 40. A post of the secondary gate 16 hits the underside of stop portion 54 to stop the vertical lifting of secondary gate 16.

U-shaped frame 12 is supported, relative to its environment, by lower horizontal support member 40 laying on grass, stone, tile, concrete, wood, or the floor of a patio or other outside or inside surface.

U-shaped frame 12 is further supported, relative to its environment, by being engaged to vertical bases 28, 30, which are secured to walls or fence posts or other vertical running surfaces. Each of the vertical bases 28, 30 is preferably a tube 56, such as a metal tube, such as a stainless steel or aluminum tube. Tube 56 is secured to a vertically running surface by one or more brackets 58, as shown in FIGS. 9A, 9B, 10A, and 10B. Bracket 58 is rigid and abuts the inner end and two sides of tube 56. Bracket 58 has pin connector openings for fastening the bracket and thus tube 56 to a vertically running surface.

Each of the vertical bases 28, 30 includes a lower socket 60 and an upper socket 62. Each of the sockets 60, 62 includes an upper open end 64. Each of the sockets 60, 62 is box like in shape. Each of the sockets 60, 62 includes a slot 66 in an inner plate, where the inner plate faces the U-shaped frame 12. The slot 66 extends downwardly from and is in communication with the upper open end 64. Slot 66 is disposed about midway between the sides of the box of the socket 60 or 62 and terminates about midway between the upper and lower ends of the socket 60 or 62. Slot 66 is flared at its upper edges to guide the support and adjustment members 32, 34, 36, 38 into the slot 66.

Confronting the upper open end 64 of upper socket 62 is a swinging stop 68. Swinging stop 68 is pivotally affixed at one end to tube 56. At the other end, swinging stop 68 includes a bent stop portion 70 that confronts the upper open end 64 and slot 66. Bent stop portion 70 extends from a body of the swinging stop 68 inwardly toward the U-shaped frame 12. Bent stop portion 70 extends at a right angle from a body of the swinging stop 68. Swinging stop 68 is L-shaped. Swinging stop 68 is frictionally mounted to the inner face of tube 56 such that stop portion 70 may be held in place to confront upper open end 64 or such that stop portion 70 may be swung out-of-the-way of the upper open end 64. For example, stop portion 70 can be swung so as to be beyond one of the sides of the tube 56 such that the body of the swinging stop 68 is in a horizontal position. Or the stop portion 70 can be swung so as to be beyond the upper end of the tube 56 such that the body of the swinging stop is in a vertical position and opposite of the operating confronting position where the stop portion 70 is adjacent to the upper open end 64 of upper socket 62. Lower sockets 60 are associated with no swinging stop 68. Each of the vertical bases 28, 30 have one swinging stop 68 and such swinging stop 68 is associated with the upper socket 62.

Vertical base 30 is spaced from and runs parallel to vertical support 44 of the U-shaped frame 12. Vertical base 28 is spaced from and runs parallel to vertical support 42 of U-shaped frame 12.

Frame or gate extension 26 is mounted between vertical base 28 and vertical support 42 of U-shaped frame 12. Frame or gate extension 26 includes a lower horizontal support member 72, an upper horizontal member 74, an outer vertical member 76 and an inner vertical member 78. Members 72, 74, 76, and 78 are rigidly joined, such as by welding. Frame or gate extension 26 is one-piece and may be integrally formed. Frame or gate extension 26 further includes an internal support network or grid 80 having a vertical support member and four horizontally extending support members. The network 80, and its vertical and horizontal support members, may be composed of a wire grid, posts, tubes, or hollow poles. Network 80 may be welded to members 72, 74, 76 and 78.

Each of the support and adjustment members 32, 34, 36 and 38 includes a threaded shaft 82, a hand wheel 84 mated to and turnable on the threaded shaft 82, and an end disk 86. The end disk 86 is rigidly mounted to the shaft 82. End disk 86 does not travel horizontally on the shaft 82. Hand wheel 84 travels incrementally, horizontally, longitudinally, and axially on the threaded shaft 82 as hand wheel 84 is turned.

On the lower gate extension side 26 of the double door gate apparatus 10, the threaded shaft 82 of support and adjustment member 36, extends horizontally and inwardly from the end disk 86, through the hand wheel 84, into the lower horizontal support member 72 of gate extension 26, and then into the lower horizontal support member 40 of U-shaped frame 12. More particularly, inserts such as plastic inserts are mounted in the ends of lower horizontal support member 72 and the adjacent end of horizontal support member 40 to receive shaft 82.

On the upper gate extension side 26 of the double door gate apparatus 10, the threaded shaft 82 of support and adjustment member 32, extends horizontally and inwardly from the end disk 86, through the hand wheel 84, into the upper horizontal support member 74 of gate extension 26, and then into the upper horizontal support member 46 of U-shaped frame 12. More particularly, inserts such as plastic inserts are mounted in the ends of upper horizontal support member 74 and the adjacent end of horizontal support member 46 to receive shaft 82.

On the lower end of vertical base 30, the threaded shaft 82 of support and adjustment member 38, extends horizontally and inwardly from the end disk 86, through the hand wheel 84, and into the lower horizontal support member 40 of U-shaped frame 12. More particularly, one or more inserts such as plastic inserts are mounted in the adjacent end of lower horizontal support member 40 to receive shaft 82.

On the upper end of vertical base 30, the threaded shaft 82 of support and adjustment member 34, extends horizontally and inwardly from the end disk 86, through the hand wheel 84, and into the upper horizontal support member 48 of U-shaped frame 12. More particularly, one or more inserts such as plastic inserts are mounted in the adjacent end of upper horizontal support member 48 to receive shaft 82.

The above noted inserts, secured in such ends as called out above, do not mate with threaded shaft 82 but have openings that receive the threaded shaft 82 and confine movement, such as upwardly, downwardly, or side to side movement, of the threaded shaft 82.

The hand wheel 84 of support and adjustment member 36 opposes and works against the hand wheel 84 of support and adjustment member 38 and pinches the U-shaped frame 12 therebetween so as to minimize movement of the U-shaped frame 12 in the direction defined by the axis of the shafts 82.

The hand wheel 84 of support and adjustment member 32 opposes and works against the hand wheel 84 of support and adjustment member 34 and pinches the U-shaped frame 12 therebetween so as to minimize movement of the U-shaped frame 12 in the direction defined by the axis of the shafts 82.

The four shafts 82 of the support and adjustment members 32, 34, 36, 38 may be pushed relatively outwardly or relatively inwardly to dispose the end disks 86 at their desired locations. At one location, vertical posts 28, 30 may be set relatively far apart and, at this location, the four shafts 82 may be set so as to have a large portion of their shafts outside of the U-shaped frame 12 and the gate extension 26. At another location, vertical posts 28, 30 may be set relatively closely together and, at this location, the four shafts 82 may be set so as to have a large portion of their shafts inside of the U-shaped frame 12 and the gate extension 26.

Vertical posts 28, 30 can be set up at and mounted to their desired locations. Then the shafts 82 can be pulled out or pushed in to match the distance between the vertical posts 28, 30. Then the swinging stops 68 are swung out of the way of upper sockets 62, and then the U-shaped frame 12, including the main and secondary gates 14, 16 and the gate extension 26, can be dropped down into the upper and lower sockets 60, 62, with the shafts 82 dropping into the slots or seats 66. Then the swinging stops 68 can be swung back to confront the sockets 62. Then the hand wheels 84 can be turned inwardly to tighten the U-shaped frame 12 between the vertical bases 28, 30.

Vertical bases 28, 30, U-shaped frame 12, gate extension 26, main gate 14, and secondary gate 16 are disposed in a common plane when main gate 14 and secondary gate 16 are in their closed positions.

Main gate 14 includes a frame 87 having an outer end vertical support member 88, an inner end vertical support member 90, a lower horizontal support member 92, an upper horizontal support member 94 and an internal support network 96 of elongate members.

Main gate 14 slides upwardly and downwardly on a pivot member 98 running vertically from horizontal support member 40 to horizontal support member 46. Pivot member 98 may be a pin, rod, post or tubular member. Pivot member 98 runs through outer end vertical support member 88 of main gate 14. Instead of a single pivot member 98, pivot member 98 may include an upper pivot member extending downwardly from horizontal support member 46 and a lower pivot member extending upwardly from horizontal support member 40. To secure the pivot member 98 in the vertical member 88, vertical member 88 may include plastic inserts that journal the pivot member 98 therein to provide for relatively free and easy swinging of the main gate 14 about an axis of the pivot member. The plastic inserts also provide for relatively free and easy upward and downward sliding of the main gate 14 on the pivot member 98. The upper end of vertical support member 88 hits stop portion 52 when lifted to its fullest extent. The lower end of vertical support member 88 rests on the upper surface of horizontal support member 40 when main gate 14 is not lifted. Such provides more than sufficient clearance to permit latch 20 to become unlatched when the main gate 14 is lifted.

Lower support member 92 of the main gate 14 extends from the vertical support member 88 to the inside surface of the inner vertical support member 90. Lower support member 92 is spaced from horizontal support member 40 when the main gate 14 is not being lifted and when the lower end of vertical member 88 rests on horizontal support member 40. The outer end of lower support member 92 is spaced from the bottom end of vertical support member 88. The inner end of lower support member 92 is adjacent to latch mechanism 20.

The inner end vertical support member 90 runs from the inner end of lower horizontal support member 92 to the underside of upper horizontal support member 94. A portion of the latch mechanism 20 is mounted to the lower end of vertical support member 90. The upper end of the vertical support member 90 confronts the inner end of horizontal support member 94. Inner end vertical support member 90 is spaced from the inner end of secondary gate 16.

Upper horizontal support member 94 runs from the inside of outer end vertical support member 88 to the upper end of vertical support member 90. Upper horizontal support member 94 mounts a portion of latch mechanism 18.

A main gate handle 100 is mounted on upper horizontal support member 94. Main gate handle 100 includes a pair of respective outer and inner end vertical members 99, 101 and a curving member 103 extending between the end vertical members. This curve includes a peak 105 that is not midway between the end vertical members 99, 101. The peak 105 of this curve is about midway between vertical support members 42, 44 of the U-shaped frame 12.

The support network or grid 96 is mounted between vertical members 88 and 90 and between horizontal members 92 and 94. Like with network 80, network or grid 96 may be composed of a wire grid, posts, tubes, or hollow poles. Network 96 may be welded to members 88, 90, 92 and 94.

Figure 2:
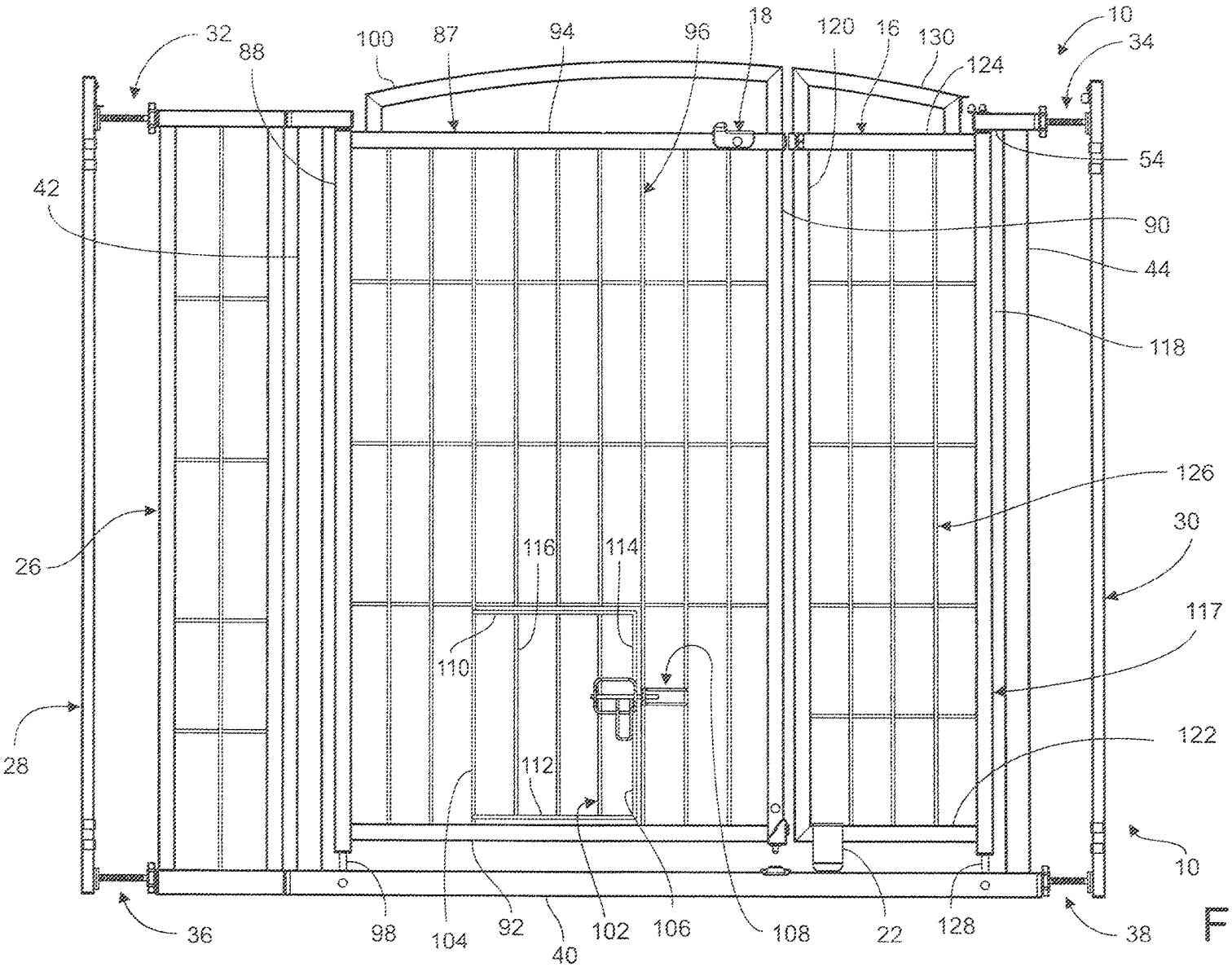
FIG. 2 shows a front view of the double door gate apparatus of FIG. 1 where the swinging ends of the main gate and secondary gate are disengaged from each other and further disengaged from the frame of the double door gate apparatus, and where each of the main gate and secondary gate has been slidingly lifted on its respective pivot axis.
Figure 3:
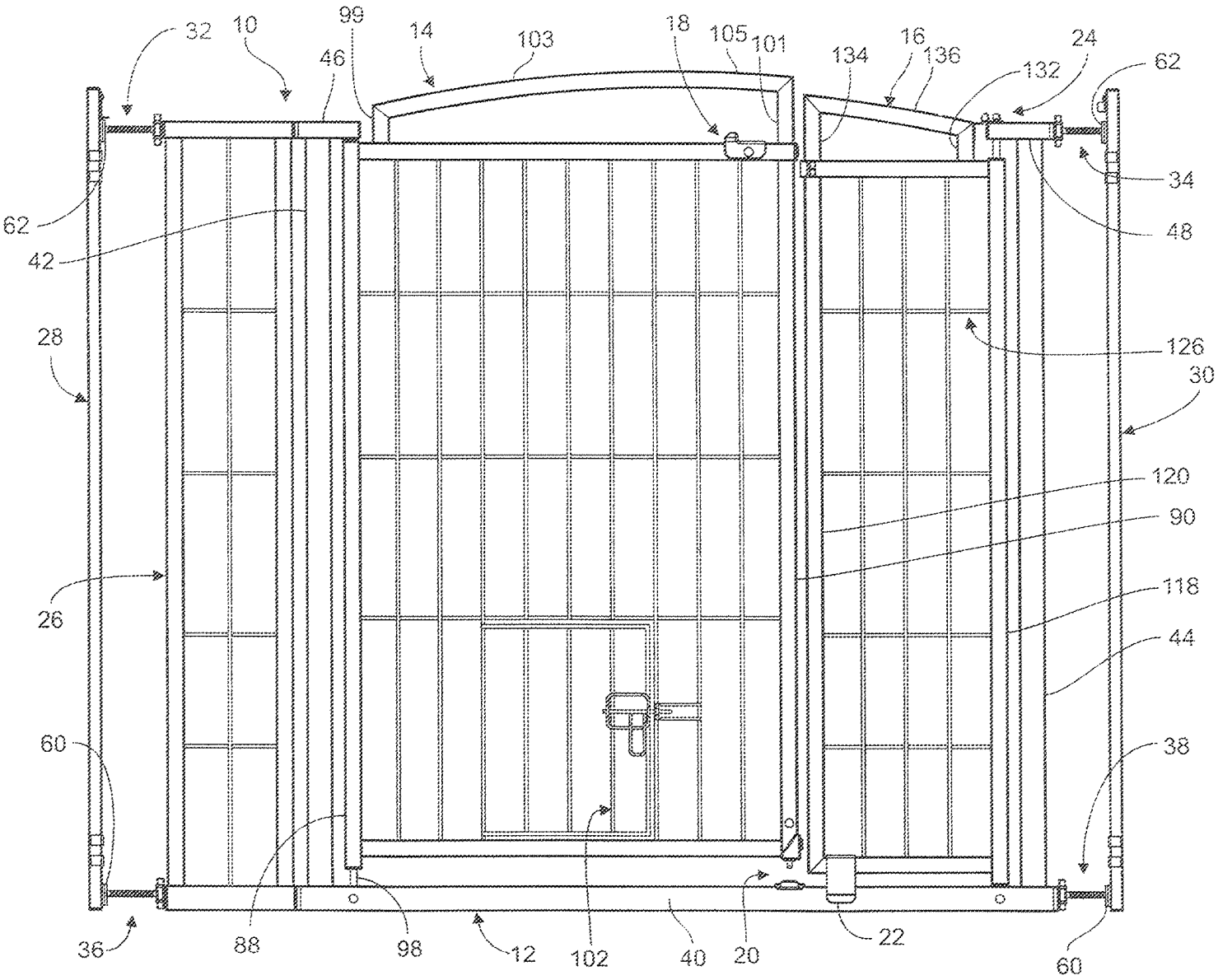
FIG. 3 shows a front view of the double door gate apparatus of FIG. 1 where the swinging end of the main gate is disengaged from the secondary gate and the frame of the double door gate apparatus and where the swinging end of the secondary gate is engaged to the frame of the double door gate apparatus, where the main gate has been slidingly lifted on its pivot axis, and where the secondary gate is in a rest position.

As shown in FIG. 2, a pet door 102 is formed in the network 96. Pet door 102 pivots on a vertically disposed support member 104 that defines an axis for a swinging of the pet door 102. Pet door 102 includes a swinging, latachable end 106. A latch mechanism 108 is disposed between the pet door 102 and the remaining portion of the network 96. Latch mechanism 108 can be hand operated from either face of the main gate 14. Upper and lower horizontally extending members 110, 112 each have an end looped about vertical member 104 and then extend inwardly therefrom to inner end vertical support member 114. Three internal vertical support members 116 run from lower member 112 to upper member 110. Pet door 102 can swing out to either of the faces of the main gate 14. Lower horizontal support member 112 is spaced from and adjacent to lower horizontal member 92 of main gate 14. Upper horizontal support member 110 is spaced from and adjacent to a horizontal support member of the main gate network 96 that extends from vertical support member 88 to vertical support member 90 of the main gate 14. Vertical support member 114 of the pet door 102 is spaced from and adjacent to a vertical support member of the main gate network 96 that runs from horizontal support member 92 to horizontal support member 94 of the main gate 14. Operation of the pet door 102 is independent of operation of the main gate 14. Pet door 102 can be open or closed whether main gate 14 is open or closed or in the process of being opened or closed. Relative to a plane in which main gate 14 lies, pet door 102 can be opened from a zero degree position (i.e., a closed position) to about a 179 degree position. Such opening to about a 179 degree position can be made to either face of the main gate 14. The pivot connection between horizontal support member 110 of the pet door 102 and vertical support member 104 of the main gate 14 is a friction fit connection, and the pivot connection between horizontal support member 112 of the pet door 102 and vertical support member 104 of main gate 14 is a friction fit connection, such that pet door 102 can be held by such a friction fit in an open position such that the pet door 102 does not swing closed such as when main gate 14 is being opened or closed. With such a friction fit the homeowner need not repeatedly open pet door 102 for a pet such as a dog. With such a friction fit, the pet door 102 can be held at any position between the zero degree position (closed position) and the 179 degree position (most open position). With the friction fit, the homeowner can be assured that the pet door 102 remains open for the pet to come and go as the pet pleases regardless of the people-use of the main gate 14. Washers or inserts or plastic inserts between the horizontal members 110, 112 and the pivot support member 104 provide such friction fit. Pet door 102 includes no internal horizontally extending support members, with the exception of members making up the latch mechanism 108.

As shown in FIG. 2, secondary gate 16 includes a frame 117 having an outer end vertical support member 118, an inner end vertical support member 120, a lower horizontal support member 122, an upper horizontal support member 124, and an internal network or grid 126 of elongate members.

Secondary gate 16 slides upwardly and downwardly on a pivot member 128 running vertically from horizontal support member 40 to horizontal support member 48. Pivot member 128 may be a pin, rod, post or tubular member. Pivot member 128 runs through outer end vertical support member 118 of secondary gate 16. Instead of a single pivot member 128, pivot member 128 may include an upper pivot member extending downwardly from horizontal support member 48 and a lower pivot member extending upwardly from horizontal support member 40. To secure the pivot member 128 in the vertical member 118, vertical member 118 may include plastic inserts that journal the pivot member 128 therein to provide for relatively free and easy swinging of the secondary gate 16 about an axis of the pivot member 128. The plastic inserts also provide for relatively free and easy upward and downward sliding of the secondary gate 16 on the pivot member 128. The upper end of vertical support member 118 hits stop portion 54 when lifted to its fullest extent. The lower end of vertical support member 118 rests on the upper surface of horizontal support member 40 when secondary gate 16 is not lifted. Such provides more than sufficient clearance to permit saddle 22 to become disengaged from horizontal support member 40 when the secondary gate 16 is lifted.

Lower support member 122 of the secondary gate 16 extends from the vertical support member 118 to the inner vertical support member 120. Lower support member 122 is spaced from horizontal support member 40 when the secondary gate 16 is not being lifted and when the lower end of vertical member 118 rests on horizontal support member 40. The outer end of lower support member 122 is spaced from the bottom end of vertical support member 118. The inner end of lower support member 122 is adjacent to saddle 22. The inner end vertical support member 120 runs from the inner end of lower horizontal support member 122 to the underside of upper horizontal support member 124. The upper end of the vertical support member 120 confronts the inner end of horizontal support member 124. Inner end vertical support member 120 is spaced from the inner end of main gate 14. Inner end vertical support member 120 is spaced from the inner end vertical support member 90 of main gate 14.

Upper horizontal support member 124 runs from the inside of outer end vertical support member 118 to the upper end of vertical support member 120. Upper horizontal support member 124 mounts a portion of latch mechanism 18.

A secondary gate handle 130 is mounted on upper horizontal support member 124. Secondary gate handle 130 includes a pair of respective outer and inner end vertical members 132, 134 and a curving member 136 extending between the end vertical members 132, 134. This curving member 136 rises in elevation from outer end vertical member 132 to inner end vertical member 134. Then, when main gate 14 and secondary gate 16 are closed, curving member 136 transitions along the same arc into curving member 103 of main gate handle 100. Peak 105 is midway between outer end vertical member 99 of main gate handle 100 and outer end vertical member 132 of secondary gate 16. Main gate handle 100 and secondary gate handle 130 are rigidly affixed to respective main gate 14 and secondary gate 16. Members 99, 101, 103, 132, 134 and 136 that make up the handles 100, 130 are tubular and may be formed of a metal such as stainless steel or aluminum. The arc or semi-circular form provided by curving members 103 and 136 is associated with the locations of the main and secondary gates 14, 16 and, for example, lets the user know that there are two gates in the double door gate apparatus 10.

The support network or grid 126 is mounted between vertical members 118 and 120 and between horizontal members 122 and 124. Like with networks 80 and 96, network or grid 126 may be composed of a wire grid, posts, tubes, or hollow poles. Network 126 may be welded to members 118, 120, 122 and 124.

When neither of the main and secondary gates 14, 16 are lifted, when both of such gates 14, 16 are resting upon horizontal member 40 of the U-shaped frame 12, the axis of upper horizontal support member 94 of main gate 14 is aligned in a straight line with the axis of upper horizontal support member 124 of secondary gate 16 and, likewise, the axis of lower horizontal member 92 of main gate 14 is aligned in a straight line with the axis of lower horizontal member 122 of secondary gate 16 and, likewise, the axes of the horizontal support members of the networks 96 and 126 are aligned in straight lines.

Figure 4B:
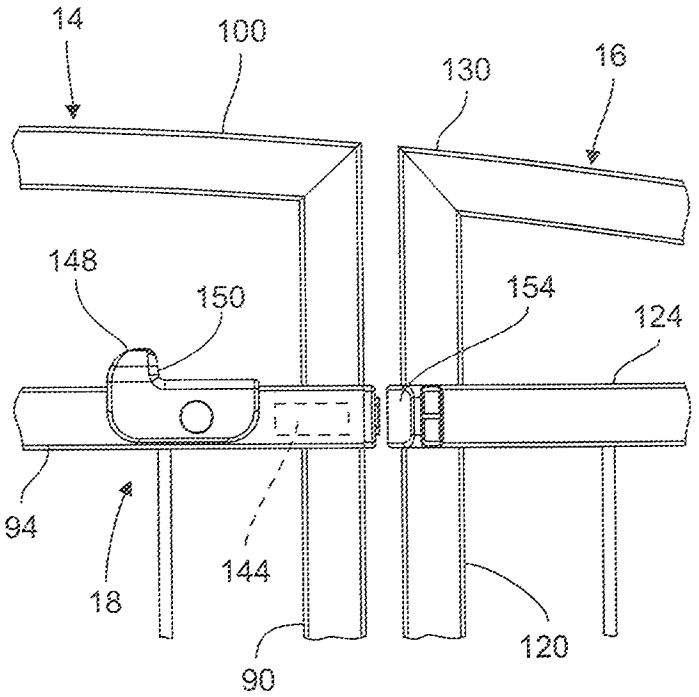
FIG. 4B is a detail front view of the upper latch mechanism of FIG. 4A, and shows the upper latch mechanism in an unlatched position.
Figure 4A:
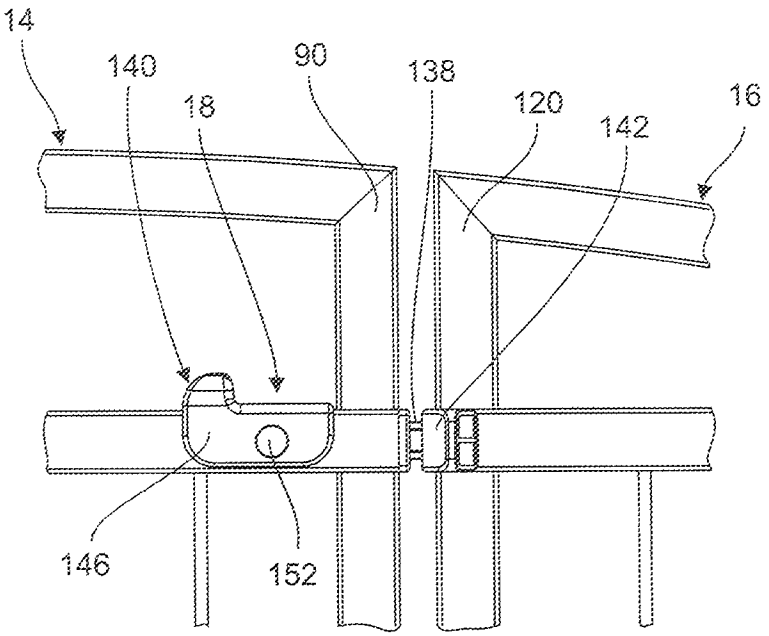
FIG. 4A is a detail front view of the upper latch mechanism between the main gate and secondary gate of the double door gate apparatus of FIG. 1, and shows the upper latch mechanism in a latched position.

Latch mechanism 18 is shown in FIGS. 4A and 4B. Latch mechanism 18 includes a latch 138 that is engaged to a latch body 140. A distal end of latch 138 is received in a latch receiver 142. A coil spring 144 engaged to the latch 138 biases the latch 138 to the closed position shown in FIG. 4A. When the latch 138 is in the open position shown in FIG. 4B, the coil spring 144 is compressed. In the open position, the distal end of the latch 138 is withdrawn out of the latch receiver 142. Latch body 140 includes a handle 146. When the handle 146 is released, the latch 138 is automatically slid to the closed protruding position by the expansion of the coil spring 144. The handle 146 slides horizontally along upper horizontal support member 94 of main gate 14. Handle 146 is generally U-shaped in section to confront each of the opposing sides of support member 94 and the top of support member 94. Handle 146 includes a protrusion 148 having a vertical or transverse surface 150. A finger or hand can push against the vertical surface 150 to operate the sliding handle 146 and open the latch 138. Coil spring 144 is mounted inside of tubular horizontal member 94. Latch 138 slides inside of tubular horizontal member 94 and includes a distal end that slides out of member 94 and into the latch receiver 142 mounted on the horizontal support member 124 of the secondary gate 16. The outer portion of the latch body 140 is engaged to the inner portion of the latch body 140 through a pin 152. Pin 152 slides in a slot formed in each of the opposing sides of horizontal support member 94. The outer portion of the latch body 140 includes at least the handle 146, protrusion 148 and vertical surface 150. The inner portion of the latch body 140 includes at least the pin 152, the latch 138 and the coil spring 144. The latch receiver 142 includes an opening for receiving the inner end of the latch 138. The latch receiver 142 includes a pair of tapering or angled faces 154 leading into the opening for the inner end of the latch 138. When the main gate 14 is being closed, there is no need to draw the handle 146 in a direction toward outer end support member 88 because the distal end of the latch 138 will be pushed in such direction by the tapering faces 154 as the latch 138 is moving into the plane of the U-shaped frame 12. Then, when the distal end of the latch 138 meets the proximal end of the tapering faces 154, the distal end of the latch 138 is pushed by the coil spring 144 into the latch receiver 142. Latch 138 slides horizontally when traveling between open and closed positions. Latch receiver 142 is engaged to upper horizontal support member 124 of the secondary gate 16 Latch receiver 142 can be a molded plastic piece. Latch receiver 142 protrudes from an inner face of vertical support member 120 so as to protrude into the space between the main and secondary gates 14, 16. The distal end of the latch 138, when in an open position such as shown in FIG. 4B, protrudes into the space between the main and secondary gates 14, 16 and is spaced from and adjacent to the proximal end of the latch receiver 142 so as to minimize sliding of the latch 138 for opening and closing of the gates 14, 16.

Figure 5B:
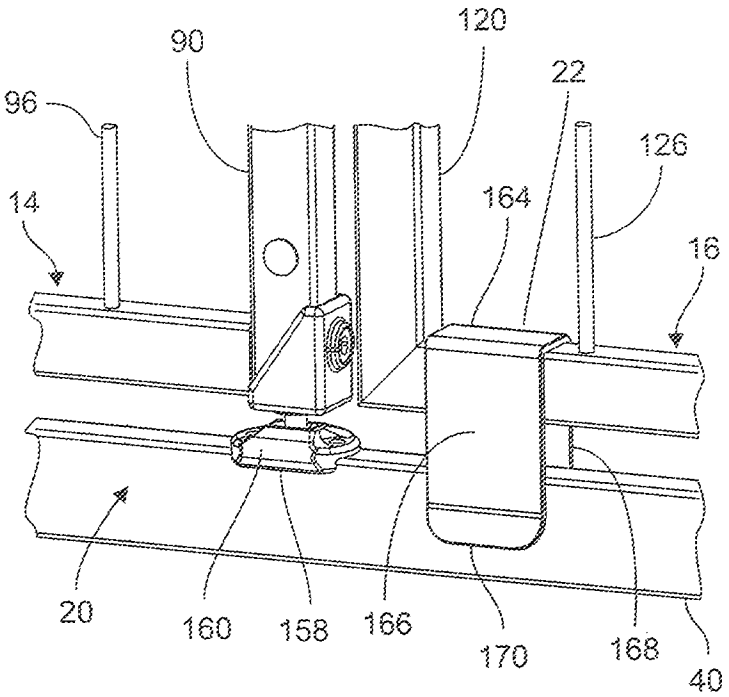
FIG. 5B is a detail perspective view of the bottom latch mechanism of the main gate and the saddle mechanism of the secondary gate of the double door gate apparatus of FIG. 1, where the bottom latch mechanism of the main gate is latched to the frame of the double door gate apparatus and where the bottom saddle mechanism of the secondary gate is engaged to the frame of the double door gate apparatus.
Figure 5A:
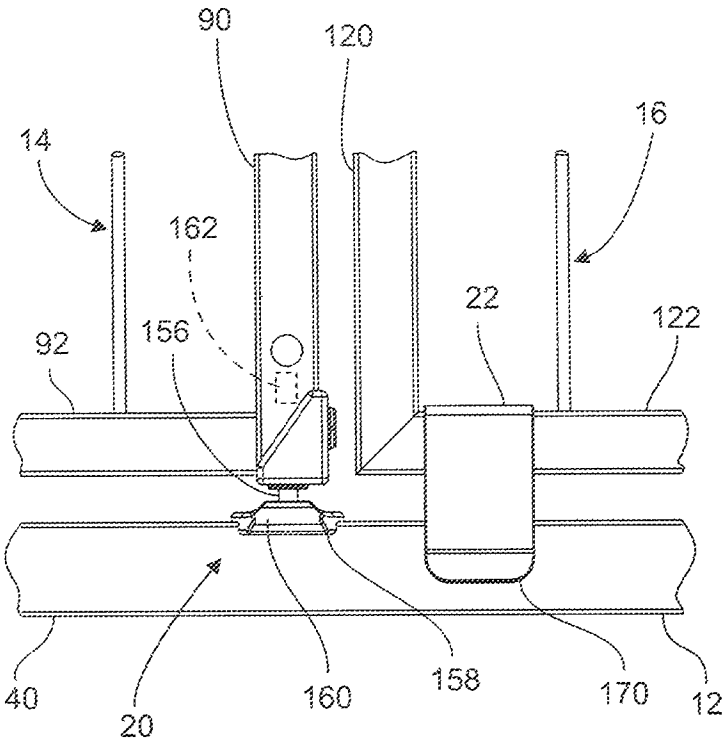
FIG. 5A is a detail front view of the bottom latch mechanism of the main gate and the saddle mechanism of the secondary gate of the double door gate apparatus of FIG. 1, where the bottom latch mechanism of the main gate is latched to the frame of the double door gate apparatus and where the bottom saddle mechanism of the secondary gate is engaged to the frame of the double door gate apparatus.
Figure 6B:
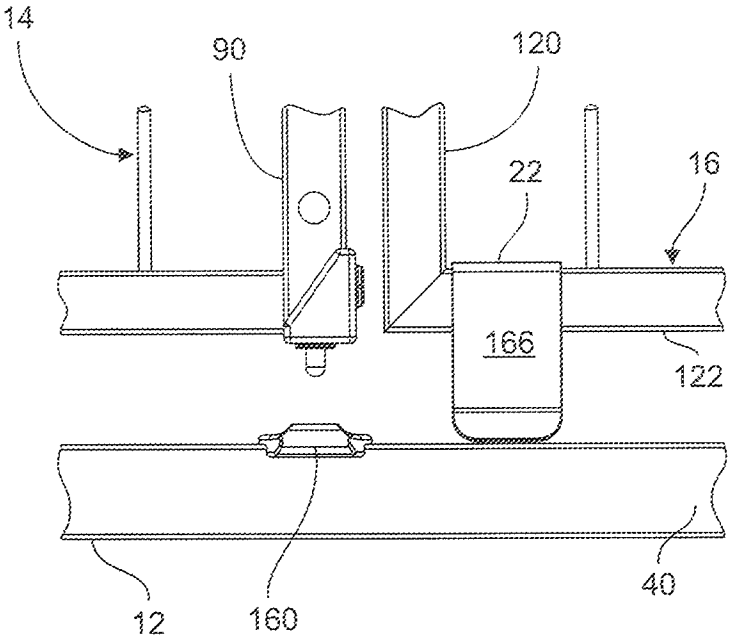
FIG. 6B is a detail front view of the bottom latch mechanism of the main gate and the saddle mechanism of the secondary gate of FIG. 6A, where the bottom latch mechanism of the main gate is unlatched from the frame of the double door gate apparatus and where the bottom saddle mechanism of the secondary gate is disengaged from the frame of the double door gate apparatus.
Figure 6A:
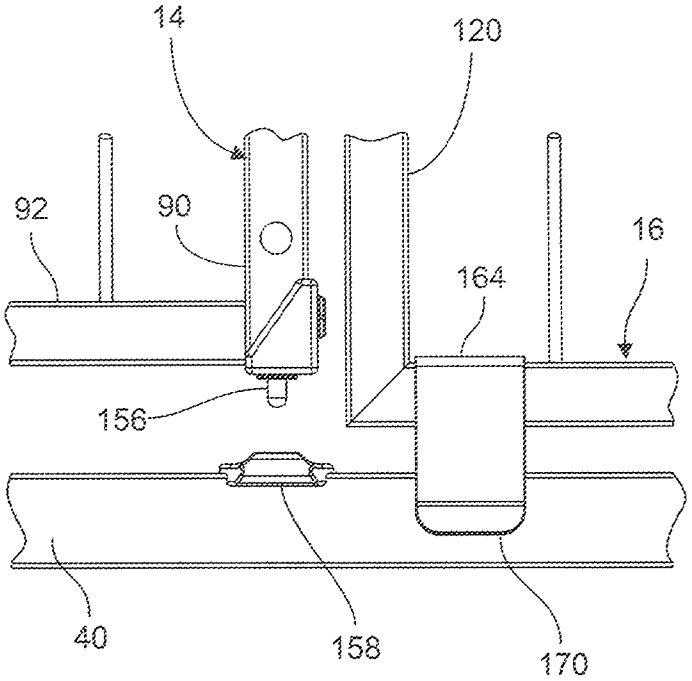
FIG. 6A is a detail front view of the bottom latch mechanism of the main gate and the saddle mechanism of the secondary gate of the double door gate apparatus of FIG. 1, where the bottom latch mechanism of the main gate is unlatched from the frame of the double door gate apparatus and where the bottom saddle mechanism of the secondary gate is engaged to the frame of the double door gate apparatus.

FIG. 5A shows latch mechanism 20 engaged between the main gate 14 and the horizontal support member 40 of the U-shaped frame 12, and FIG. 6A shows latch mechanism 20 disengaged from the horizontal support member 40 of the U-shaped frame 12. Latch mechanism 20 includes a latch 156 having a distal end that is slideable vertically into and out of a latch receiver 158. Latch receiver 158 has a pair of opposing tapered or angled faces 160 that lead upwardly and inwardly into an opening for the distal end of the latch 156. Latch mechanism 20 further includes a coil spring 162 that continually biases the distal end of the latch 156 downwardly to the closed position, to a position where the distal end of the latch 156 protrudes from the bottom end of the inner end vertical support member 90. The latch 156, and the distal end of the latch 156, are automatically retracted upwardly when the distal end of the latch 156 hits one of the tapering faces 160 of the latch receiver 158, such as when the main gate 14 is swinging closed from either of the faces of the U-shaped frame 12. Latch receiver 158 may be plastic or metal and is mounted on the horizontal support member 40 of U-shaped frame 12 with pin connectors. Latch receiver 158 and the latch receiving faces 160 protrude into the space between the lower horizontal support member 92 of main gate 14 and the horizontal support member 40 of the U-shaped frame. Latch 156 is disposed in and retracts upwardly into tubular vertical support member 90.

FIG. 5B shows saddle 22 engaged between secondary gate 16 and the horizontal support member 40 of the U-shaped frame 12 and FIG. 6B shows the saddle 22 disengaged therefrom. Saddle 22 is U-shaped and is fixed to lower horizontal support member 122 of secondary gate 16 in an inverted U-shaped fashion. Saddle 22 includes an upper end that confronts the upper face of horizontal member 122 and two sides 166, 168. Each of sides 166, 168 includes a flared bottom end 170. Each of the sides 166, 168 confronts one of the sides of the horizontal support member 40 of the U-shaped frame 12. These sides 166, 168 and saddle 22 as a whole prevent the secondary gate 16 from swinging open when the saddle 22 is engaged to the horizontal support member 40. When the secondary gate 16 is lifted, the bottom edges of the flared ends 170 rise above the top surface of the horizontal support member 40 of the U-shaped frame 12, thereby permitting the secondary gate 16 to swing open to either of the faces of the U-shaped frame 12. When the secondary gate 16 is swung to a position where the secondary gate 16 is substantially in the same plane as the U-shaped frame 12, then the secondary gate 16 may be lowered such that once again the saddle 20 engages the horizontal support member 40. The flared ends 170 are spaced apart at a distance that is greater than the distance that the flat portions of sides 166, 168 are spaced apart such that secondary gate 16 and the horizontal support member 40 need not be perfectly aligned for the saddle 22 to capture the horizontal support member 40. Each of the flared ends 170 taper downwardly and outwardly from its respective flat portion of its respective side 166, 168. Each of the flat portions of sides 166, 168 is disposed in a plane. Each of the flat portions of sides 166, 168 is a flat, sheet-like section and the saddle 22 as a whole may be manufactured from a piece or strip of sheet metal.

Saddle 22 is mounted on secondary gate 16 on an inner end portion of the secondary gate 16. Saddle 22 is mounted adjacent to the inner end vertical member 120. Saddle 22 is mounted on the secondary gate 16 on a lower portion of the secondary gate 16. Saddle 22 is fixed to the lower horizontal support member 122. By fixing the saddle 22 at an inner portion of the secondary gate 16, at a relatively great distance from the pivot member 128, the secondary gate 16 is more stable when, for example, pressure is exerted on the closed secondary gate 16 in a direction crosswise to the horizontal support member 40. If the saddle 22 was mounted on an outer portion close to pivot member 128 and if pressure was exerted on the secondary gate 16 crosswise to the horizontal support member 40, the secondary gate 16 may wobble or swing slightly in the direction of such pressure. By fixing the saddle 22 at a lower portion of the secondary gate 16, the saddle 22 is unobtrusive.

Provided that latch mechanism 18 is open, secondary gate 16 and saddle 22 may be lifted and disengaged from U-shaped frame 12 when swinging stop mechanism 24 is swung to an out of the way position. If latch mechanism 18 is closed, secondary gate 16 can be lifted and disengaged from U-shaped frame 12 provided that swinging stop mechanism 24 is swung to an out of the way position and provided that main gate 14 is lifted at the same time or concurrently that the secondary gate 16 is lifted.

Saddle 22 has a relatively great amount of surface area that confronts the sides of the horizontal support member 40 of the U-shaped frame 12. This surface area extends in a direction from the outer end of the secondary gate 16 to the inner end of the secondary gate 16. In other words, the distance between one vertical edge of side 166 (or side 168) and the other vertical edge of side 166 (or side 168) is relatively great, and such distance is greater than the width of latch 156 or the width of latch 138. If desired, main gate 14 can have a saddle 22 instead of a latch mechanism 20 such that both of the gates 14, 16 have saddles 22. If desired, secondary gate 16 can have a latch mechanism 20 instead of a saddle 22 such that both of the gates 14, 16 can have latch mechanisms 20. If desired, each of the gates 14 and 16 can have multiple saddles 22 distributed along their respective lower horizontal support members 92 and 122. If desired, a saddle 22 can run substantially continuously along the entire lengths of lower horizontal support members 92 and 122. If desired, each of gates 14 and 16 can have one or more latch mechanisms 20 and one or more of saddles 22.

Saddle 22 confronts and is adjacent to latch mechanism 20. While latch 156 automatically engages latch receiver 158 when main gate 14 is closed, saddle 22 will hit the horizontal support member 40 when the secondary gate 16 is closed. Then secondary gate 16 is lifted, pivoted slightly to be in the plane of the U-shaped frame 12, and set down so as to engage the saddle 22 with the horizontal support member 40.

Figure 7B:
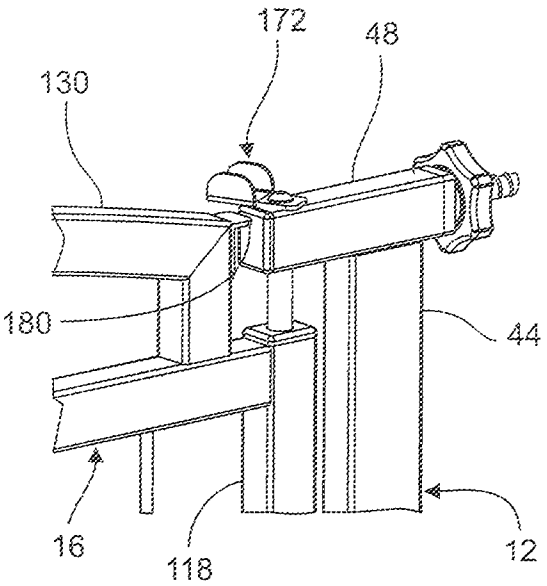
FIG. 7B is a detail perspective view of the outer stop mechanism of FIG. 7A where the outer upper stop mechanism has been swung away to permit the secondary gate to be lifted.
Figure 7A:
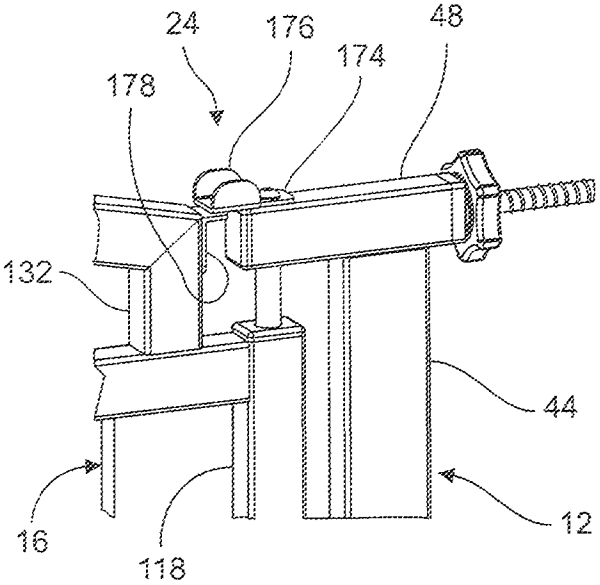
FIG. 7A is a detail perspective view of the outer upper stop mechanism of the secondary gate of the double door gate apparatus of FIG. 1 where the outer upper stop mechanism is in an operating position and prevents the secondary gate from being lifted.
Figure 8B:
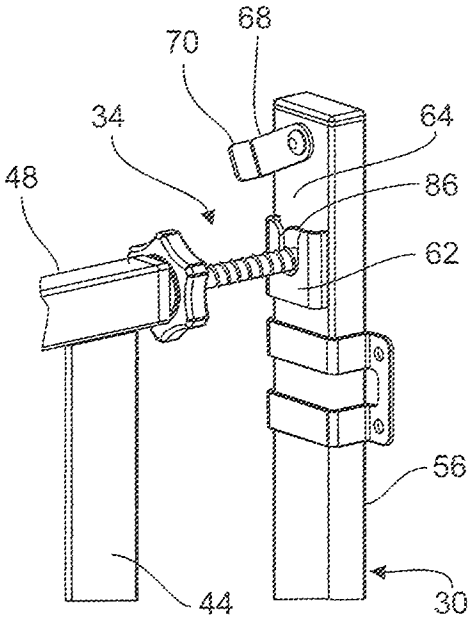
FIG. 8B is a detail perspective view of the upper end portion of FIG. 8A where a stop or lock of the socket mechanism of the vertical support member has been swung away such that the horizontal support and adjustment mechanism of the upper end portion can be placed into or removed from the socket mechanism.
Figure 8A:
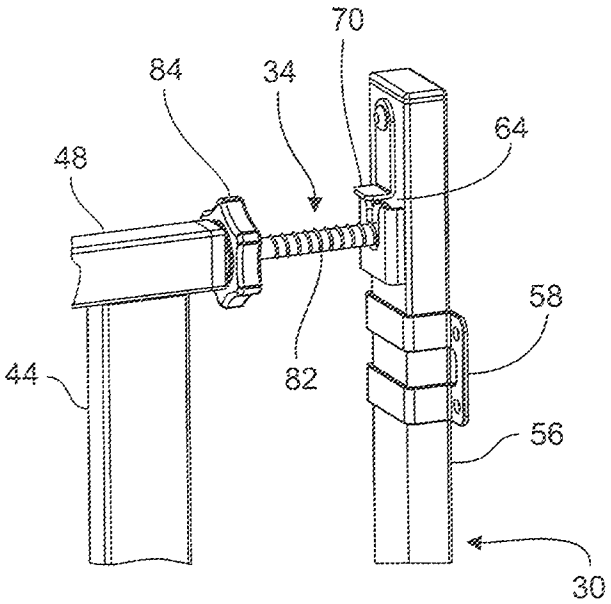
FIG. 8A is a detail perspective view of an upper end portion of the double door gate apparatus of FIG. 1, on the end of the secondary gate, where a horizontal support and adjustment member of the upper end portion is received in a socket mechanism of a vertical support member, and where a hand cranked wheel or stop is turned against a frame of the double door gate apparatus.
Figure 9B:
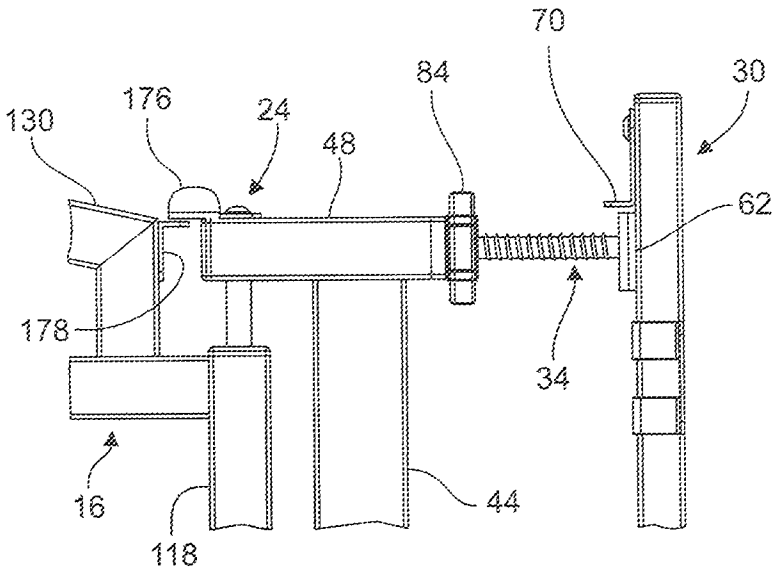
FIG. 9B is a detail front view of the upper end portion of FIG. 8A where the horizontal support and adjustment member is received in the socket mechanism of the vertical support member.
Figure 9A:
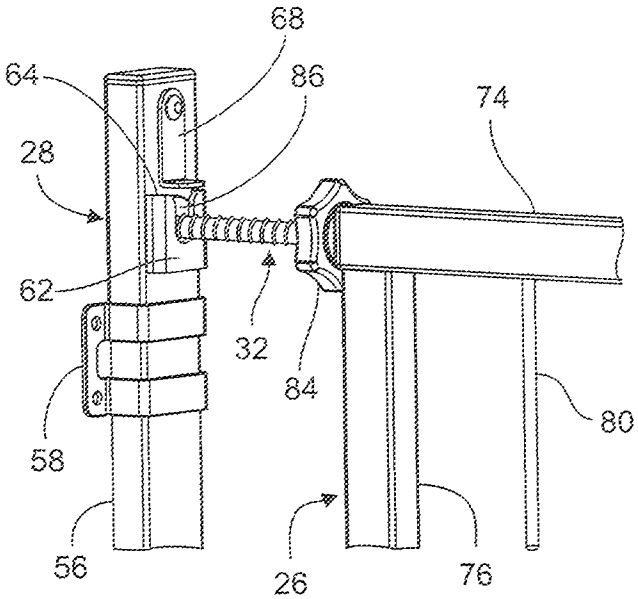
FIG. 9A is a detail perspective view of an upper end portion of the double door gate apparatus of FIG. 1, on the end of an extension of the frame of the double door gate apparatus, where a horizontal support and adjustment member of the upper end portion is received in a socket mechanism of a vertical support member, and where a hand cranked wheel or stop is turned against the extension of the frame of the double door gate apparatus.
Figure 10B:
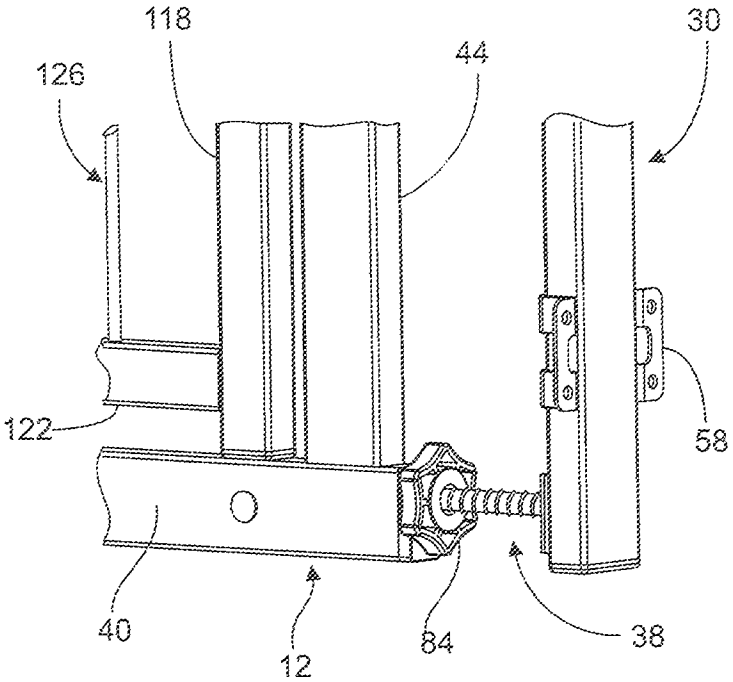
FIG. 10B is a detail perspective view of a lower end portion of the double door gate apparatus of FIG. 1, on the end of the secondary gate, where a horizontal support and adjustment member of the lower end portion is received in a socket mechanism of a vertical support member, and where a hand cranked wheel or stop is turned against a lower end portion of the frame of the double door gate apparatus.
Figure 10A:
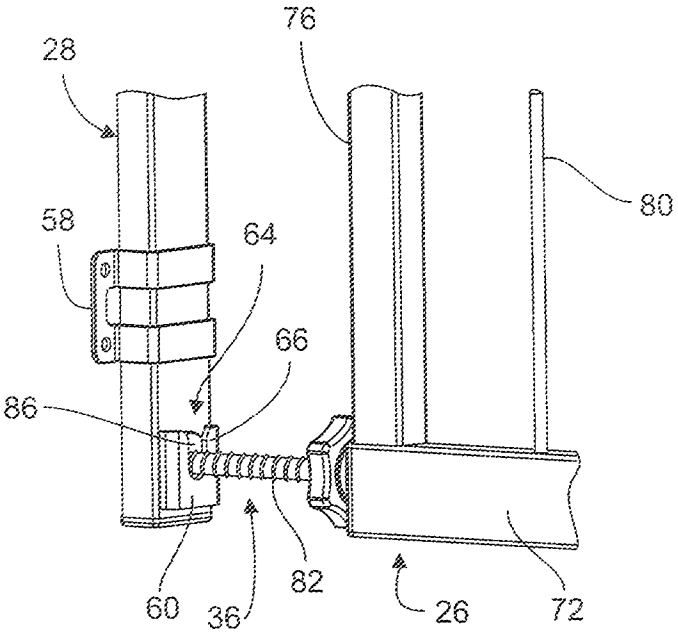
FIG. 10A is a detail perspective view of a lower end portion of the double door gate apparatus of FIG. 1, on the end of an extension of the frame of the double door gate apparatus, where a horizontal support and adjustment member of the lower end portion is received in a socket mechanism of a vertical support member, and where a hand cranked wheel or stop is turned against the extension of the frame of the double door gate apparatus.

FIGS. 7A and 7B show the swinging stop mechanism 24. Swinging stop mechanism 24 is mounted between the U-shaped frame 12 and the secondary gate 16. Swinging stop mechanism 24 includes a swinging stop 172 pivotally mounted to the top face of horizontal support member 48 of the U-shaped frame 12. Swinging stop 172 includes a flat strip 174 and a pair of finger tabs 176. Swinging stop mechanism 24 further includes an L-shaped piece 178 having a protruding section 180 extending into a space between secondary gate handle 130 and the inner end of horizontal support member 48. A user can swing swinging stop 172 to and beyond either of the side faces of the horizontal support member 48 or to a location directly on top of horizontal support member 48, where such location is in the plane of the U-shaped frame 12 and where, in such a location, flat strip 174 is in alignment with horizontal support member 48 and confronts protruding section 180 of L-shaped piece 178, thereby preventing the secondary gate 16 from being lifted, which in turn prevents the saddle 22 from disengagement with the horizontal support member 40. The underside of flat piece 176 confronts the top side of protruding section 180. When the flat piece 174 is swung to an out-of-the-way position, such as shown in FIG. 7B, protruding section 180 can be lifted upwardly beyond the horizontal support member 48, such that saddle 22 can be disengaged from horizontal support member 40, such that secondary gate 16 can be swung to either side of the U-shaped frame 12. Finger tabs 176 make it easy to manipulate and push and swing the flat strip 174 to an out-of-the-way position where the secondary gate 16 may be lifted and back to the operating position where the secondary gate 16 is blocked from being lifted. L-shaped piece 178 includes a base that is fixed to the outer face of handle member 132 and the protruding section 180. The base and the section 180 are disposed at a right angle. Protruding section 180 protrudes into a space between handle 130 and U-shaped frame 12. Flat strip 174 protrudes into the space between handle 130 and U-shaped frame 12.

In operation, to install the double door gate apparatus 10, the vertical bases 28, 30 are fixed to vertical surfaces, such as to walls found in or outside of the house, to fence posts, to garage walls, or to any other inside or outside vertical surface. Brackets 58 may be employed in this step. Straps may be employed in this step where the straps wrap about the tube 56 and a vertical support structure such as a fence post. As to such straps, the Flannery et al. U.S. Patent Application Publication Number US 2011/0175046 A1 published Jul. 21, 2011 and entitled Gate Having Four Pins And Stairway Post Adapter is hereby incorporated by reference in its entirety into this application.

To install the frame or gate extension 26, frame extension 26 is placed adjacent to the main gate 14 such that horizontal support members 72, 74 of the frame extension are aligned in a straight line with horizontal support members 40, 46 of the U-shaped frame 12. Then the shafts 82 of support and adjustment members 36 and 32 are pushed into respective horizontal support members 72, 74 of the frame extension 26 and further pushed into respective horizontal support members 40, 46 of the U-shaped frame 12. Shafts 82 slide through plastic or metal inserts in the horizontal support members 72, 74, 40, 46. The openings in the inserts are preferably not threaded. The shafts 82 preferably do not threadingly engage the inserts.

The U-shaped frame 12, having the main gate 14, the secondary gate 16, and the frame extension 26, is then placed between the vertical bases 28, 30. The bent stop portions 70 of the swinging stops 68 are swung to an out-of-the-way position and then the end disks 86 of the support and adjustment mechanisms 32, 34 and 36, 38 are dropped into their respective sockets 62, 60. Then the hand wheels 84 of the support and adjustment mechanisms 32 and 36 are turned so as to travel inwardly toward the outer ends of horizontal support members 72, 74 of the frame extension 26, and the hand wheels 84 of the support and adjustment mechanisms 34 and 38 are turned so as to travel inwardly toward the outer ends of horizontal support members 40 and 48 of the U-shaped frame 12. As the hand wheels 84 travel inwardly and bring pressure against the frame extension 26 and the U-shaped frame 12, the gate extension 26 and U-shaped frame 12 are pinched in a sturdy fashion between vertical posts 28, 30. Each of the vertical frame members 42 and 44 remains at a right angle relative to horizontal frame member 40.

To get through the main gate 14 only, with the secondary gate 16 remaining in a closed position where saddle 22 is engaged to horizontal support member 40 and where swinging stop 24 is closed to prevent the secondary gate 16 from being lifted, a user goes through a two-step process. The first step is to open latch mechanism 18. Mechanism 18 is opened by sliding latch body 140 away from outer end vertical member 90 so as to slide the distal end of the latch 138 out of the latch receiver 142 on the secondary gate 16. The second step is to open latch mechanism 20. Mechanism 20 is opened by lifting up the main gate 14 so as to disengage latch 156 from latch receiver 158 on the horizontal support member 40 of the U-shaped frame 12. Horizontal support member 46 or stop 46 limits the vertical travel of main gate 14 by limiting vertical travel of the outer end vertical member 88, the upper end of which hits the underside of the horizontal support member 46. When main gate 14 is at rest with the bottom end of outer end vertical support member 88 on the horizontal support member 40, the distance between the upper end of outer end vertical support member 88 and the underside of stop or horizontal support member 46 is greater than the distance that the distal end of latch 156 travels from an engagement position to a disengagement position with latch receiver 158. When latch mechanisms 18 and 20 are unlatched, main gate 14 is free to be swung in either the clockwise or counter-clockwise directions, i.e., to either of the faces of the U-shaped frame 12. Then a person may walk through the main gate 14. The main gate 14 may be swung for about 179 degrees in either direction. To shut the main gate 14, the user need only swing the main gate 14 back to be in a common plane with the U-shaped frame 12. To shut the main gate 14, the user need not operate the latch mechanisms 18 and 20 because, as the main gate 14 approaches the common plane of the U-shaped frame 12, the latches 138 and 156 retract automatically as their respective distal ends hit the tapering faces of the latch receivers 142, 158. Main gate 14 may 1) be freely swinging with minimal resistance or 2) be frictionally resistant when swung so as to remain open at a desired position, such as at 89 degrees relative to the plane of the U-shaped frame 12.

To get through the secondary gate 16 only, with the main gate 14 remaining in a closed position where latch mechanism 20 remains engaged to horizontal support member 40, a user goes through a three-step process. First, the swinging stop 24 is opened by swinging the flat strip 174 to an out-of-the-way position. Second, the latch mechanism 18 is operated to disengage the latch 138 from the latch receiver 142 of the secondary gate 16. Third, while the latch 138 is disengaged, the secondary gate 16 is lifted to disengage saddle 22 from the horizontal support member 40, whereupon secondary gate 16 can be swung. Horizontal support member 48 or stop 48 limits the vertical travel of secondary gate 16 by limiting vertical travel of the outer end vertical member 118, the upper end of which hits the underside of the horizontal support member 48. When secondary gate 16 is at rest with the bottom end of outer end vertical support member 118 on the horizontal support member 40, the distance between the upper end of outer end vertical support member 118 and the underside of stop or horizontal support member 48 is greater than the distance that the saddle 22 travels from an engagement position to a disengagement position with horizontal support member 40. When swinging stop 24 is swung out-of-the-way, when latch mechanism 18 is unlatched, and when saddle 22 is disengaged from horizontal support member 40, secondary gate 16 is free to be swung in either the clockwise or counter-clockwise directions, i.e., to either of the faces of the U-shaped frame 12. Then a person may walk through the secondary gate 16. The secondary gate 16 may be swung for about 179 degrees in either direction. To shut the secondary gate 16, the user swings the secondary gate 16 back to be adjacent to the plane of the U-shaped frame 12. Then the user lifts the secondary gate 16, opens the latch mechanism 18, aligns the saddle 20 with the horizontal support member 40, drops the secondary gate 16 into place where the saddle 22 engages the horizontal support member 40, and releases the latch mechanism 18 to permit the latch 138 to reengage with latch receiver 142. Secondary gate 16 may 1) be freely swinging with minimal resistance or 2) be frictionally resistant when swung so as to remain open at a desired position, such as at 89 degrees relative to the plane of the U-shaped frame 12.

To open the secondary gate 16 when the main gate 14 is in an open position and is swung out from the plane of the U-shaped frame 12, a two-step process is employed. First, the swinging stop 24 is opened by swinging the flat strip 174 to an out-of-the-way position. Second, the secondary gate 16 is lifted to disengage saddle 22 from the horizontal support member 40, whereupon secondary gate 16 can be swung to an open position. With both of the main gate 14 and secondary gate 16 open to their fullest extents, a person may walk through an open area bounded by outer end vertical member 88 and outer end vertical member 118. After both of the gates 14, 16 are open, either of the gates 14 or 16 may be first closed.

It should be noted that the gates 14, 16 may both be lifted at the same time when engaged to each other through latch mechanism 18. Swinging stop 24 is swung to an open position, and then gates 14, 16 may be lifted together at the same time.

It should be noted that double door gate apparatus 10 is free of an intermediate vertical post or support member extending from horizontal support member 40 to be disposed between the inner ends of the main and secondary gates 14, 16. In contrast, when main and secondary gates 14, 16 are open, only free space is disposed between inner vertical support members 90, 120 of the gates 14, 16. In contrast, when main and secondary gates 14 and 16 are closed, only latch 138 extends into the space between the confronting, adjacent inner vertical support members 90, 120.

It should be noted that the double door gate apparatus 10 is free of a horizontal support member extending between the upper ends of the vertical support members 42, 44. In other words, the frame 12 is an open top frame such that no horizontal support members extend from the first vertical support member 42 to the second vertical support member 44 other than the horizontal support member 40 over which the main and secondary gates 14, 16 swing.

The double door gate apparatus 10 can include:

a) a frame 12 having a first vertical support member 42, a second vertical support member 44, the first and second vertical support members 42, 44 being spaced apart, each of the first and second vertical support members 42, 44 having an upper end and a lower end;

b) the frame 12 further having a first horizontal support member 46, a second horizontal support member 48, and a third horizontal support member 40, the first horizontal support member 46 on the upper end of the first vertical support member 42 and extending inwardly, the second horizontal support member 48 on the upper end of the second vertical support member 44 and extending inwardly, and the third horizontal support member 40 engaged to each of the lower ends of the first and second vertical support members 42, 44;

c) a main gate 14 having an outer end and an inner end, the outer end of the main gate 14 mounted on a first pivot axis between the first horizontal support member 46 and the third horizontal support member 40, the inner end of the main gate 14 swingable across the third horizontal support member 30, the main gate 14 being slideable vertically up and down on the first pivot axis;

d) a secondary gate 16 having an outer end and an inner end, the outer end of the secondary gate 16 mounted on a second pivot axis between the second horizontal support 48 member and the third horizontal support member 40, the inner end of the secondary gate 16 being swingable across the third horizontal support member 40, the secondary gate 16 being slideable vertically up and down on the second pivot axis;

e) the first and third horizontal support members 46, 40 working as stops to limit vertical sliding of the main gate 14 on the first pivot axis; and f) the second and third horizontal support members 48, 40 working as stops to limit vertical sliding of the secondary gate 16 on the second pivot axis.

The double door gate apparatus 10 can further include the main gate 14 being engagable to and disengagable from the secondary gate 16, the main gate 14 being engagable to and disengagable from the third horizontal support member 40, the secondary gate 16 being engagable to and disengagable from the third horizontal support member 40, and the secondary gate 16 being engagable to and disengagable from the second horizontal support member 48.

Figure 11:
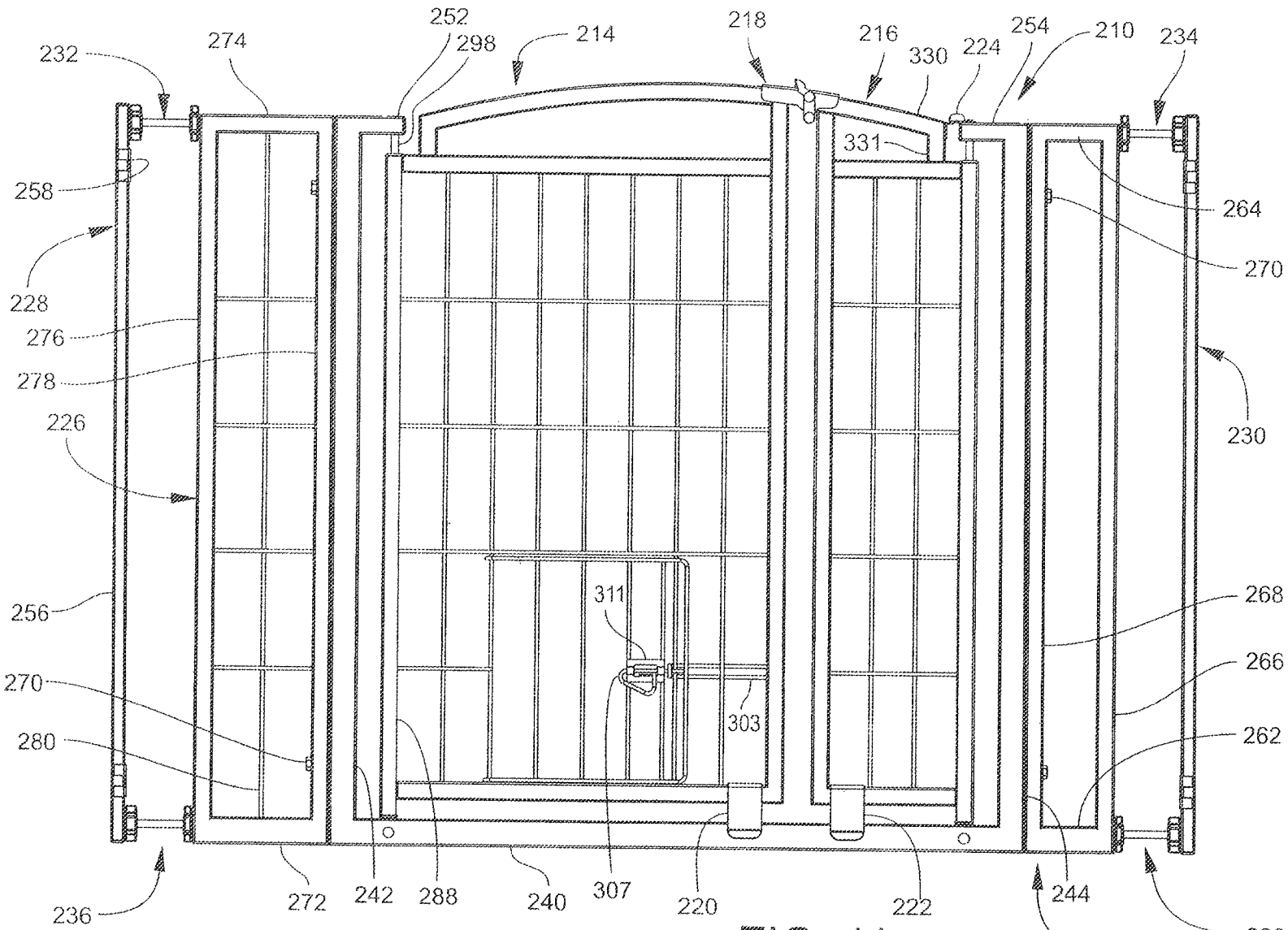
FIG. 11 shows a front elevation view of an alternate embodiment of the double door gate apparatus of the present invention where the swinging ends of a main gate and secondary gate are engaged to each other and further engaged to a frame of the double door gate apparatus, and where the main and secondary gates are in a rest or closed position.

FIG. 11 shows an alternate embodiment of the double door gate apparatus and such alternate embodiment is indicated by the reference number 210.

Double door gate apparatus 210 includes a generally U-shaped open top frame 212, a main gate 214, a secondary gate 216, a latch mechanism 218 between the main and secondary gates 14, 16, a catch or saddle 220 between the main gate 214 and the frame 212, a catch or saddle 222 between the secondary gate 216 and the frame 212, and a swinging stop mechanism 224 between the secondary gate 216 and the frame 212.

Double door gate apparatus 210 further includes a first gate extension 226, a second gate extension 227, a first vertical base 228, a second vertical base 230, a first upper horizontal support and adjustment member 232, a second upper horizontal support and adjustment member 234, a first lower horizontal support and adjustment member 236, and a second lower horizontal support and adjustment member 238.

The U-shaped frame 212 includes a lower or lowermost horizontal support member 240, a first upright vertical support member 242, a second upright vertical support member 244, a first upper horizontal support member or stop 246, and a second upper horizontal support member or stop 248. Members 240, 242, 244, 246 and 248 are rigidly fixed to one another such as by welding. Members 240, 242, 244, 246 and 248 may be one-piece and integral. One or more of the members 240, 242, 244, 246 and 248 may be tubular. Preferably each of the members 240, 242, 244, 246 and 248 is tubular. Frame 212 may be a metal frame where one or more of members 240, 242, 244, 246 and 248 are formed of a metal such as stainless steel or aluminum.

Lower horizontal support member 240 is a base member and a cross support member. Member 240 may be square in section. Member 240 may be rectangular in section so as to have a relatively low profile. Gates 214, 216 swing in both directions across member 240 and people or users or pets walk over member 240. If desired, member 240 may be a substantially flat bar or strip to provide even a lower profile to minimize feet hitting the member 240 as people walk through the gates 214, 216 as long as the surface area on vertical front and rear face portions of member 240 is sufficiently great to catch and sturdily and strongly hold catches 220, 222 of the main and secondary gates 214, 216. Member 240 has a length greater than the combined width of the main and secondary gates 214, 216.

Lowermost horizontal member 240 is engaged by catches or saddles 220, 222 on each of the vertically extending side surfaces of the lower horizontal member 240. Lowermost horizontal member 240 abuts a surface on its underside, where the surface may be concrete, wood, asphalt, dirt, grass, gravel or tile. Such surface may be an indoor surface or an outdoor surface.

Double door gate apparatus 210 is preferably not a pressure gate apparatus. Frame 212 is preferably not a pressure frame where the vertical supports 242, 244 are manufactured such that one is slightly oblique relative to member 240 such that, upon pressure induced by one or more of the support and adjustment members 232, 234, 236, 238, inner ends of the gates 214, 216 are brought together.

Each of the vertical members 242, 244 extends at a right angle to lower horizontal member 240. Each of the vertical members 242, 244 is joined to an end portion of the lower horizontal member 240 and to a top surface portion of the lower horizontal member 240. Each of the vertical members 242, 244 is flush with an absolute end of horizontal member 240. Each of the vertical members 242, 244 may be square in section and may be tubular. An uppermost portion of each of the vertical members 242, 244 stands at a lesser elevation than uppermost frame or framework portions of each of the main and secondary gates 214, 216. Vertical member 242 is spaced from the outer end of main gate 214 and vertical member 244 is spaced from the outer end of secondary gate 216. The distance between the inner sides of the vertical support members 242, 244 is greater than the combined width of the main and secondary gates 214, 216. The distance between the outer sides of the vertical support members 242, 244 is substantially equal to the length of horizontal support member 240.

Upper and inwardly extending horizontal support member 246 is mounted at the top end of vertical support member 242, such as by welding, or may be integral and one-piece therewith. Support member 246 may be square in section and may be tubular. A stop portion 252 of support member 46 extends inwardly toward main gate 214. This inwardly directed stop portion 252 limits the vertical travel or vertical sliding of the main gate 214 along its vertical axis. Main gate 214 is lifted along this vertical axis to disengage the catch or saddle 220. A post of the main gate 214 hits the underside of stop portion 252 to stop the vertical lifting of main gate 214.

Upper and inwardly extending horizontal support member 248 is mounted at the top end of vertical support member 244, such as by welding, or may be integral and one-piece therewith. Support member 248 may be square in section and may be tubular. A stop portion 254 of support member 248 extends inwardly toward secondary gate 216. This inwardly directed stop portion 254 limits the vertical travel or vertical sliding of the secondary gate 216 along its vertical axis. After swinging stop mechanism 224 is swung away, secondary gate 216 may be lifted along this vertical axis to disengage the catch or saddle 222 from the lower horizontal member 240. A post of the secondary gate 216 hits the underside of stop portion 254 to stop the vertical lifting of secondary gate 216.

U-shaped frame 212 is supported, relative to its environment, by lower horizontal support member 240 laying on grass, stone, tile, concrete, wood, or the floor of a patio or other outside or inside surface.

U-shaped frame 212 is further supported, relative to its environment, by being engaged to vertical bases 228, 230, which are secured to walls or fence posts or other vertical running surfaces. Each of the vertical bases 228, 230 is preferably a tube 256, such as a metal tube, such as a stainless steel or aluminum tube. Tube 256 is secured to a vertically running surface by one or more brackets 258, as shown in FIGS. 11, 17B, 18A, and 18B. Bracket 258 is rigid and abuts the inner end and two sides of tube 256. Bracket 258 has pin connector openings for fastening the bracket and thus tube 256 to a vertically running surface.

Vertical base 230 is spaced from and runs parallel to vertical support 244 of the U-shaped frame 212. Vertical base 228 is spaced from and runs parallel to vertical support 242 of U-shaped frame 212.

Frame or gate extension 227 is mounted between vertical base 230 and vertical support 244 of U-shaped frame 212. Frame or gate extension 227 includes a lower horizontal support member 262, an upper horizontal support member 264, an outer vertical support member 266 and an inner vertical support member 268. Support members 262, 264, 266, and 268 are rigidly joined, such as by welding. Frame or gate extension 227 may be one-piece and may be integrally formed. Frame or gate extension 227 preferably includes no internal support network or grid. Removable threaded and head pin connectors 270 run horizontally through inner vertical support member 268 and into vertical support member 244 of the U-shaped frame 212 to fix the gate extension 227 to the U-shaped frame 212.

Frame or gate extension 226 is mounted between vertical base 228 and vertical support 242 of U-shaped frame 212. Frame or gate extension 226 includes a lower horizontal support member 272, an upper horizontal support member 274, an outer vertical support member 276 and an inner vertical support member 278. Support members 272, 274, 276, and 278 are rigidly joined, such as by welding. Frame or gate extension 226 may be one-piece and may be integrally formed. Frame or gate extension 226 further includes an internal support network or grid 280 having a vertical support member and four horizontally extending support members. The network 280, and its vertical and horizontal support members, may be composed of a wire grid, posts, tubes, or hollow poles. Network 280 may be welded to support members 272, 274, 276 and 278. Removable threaded and head pin connectors 270 run horizontally through inner vertical support member 278 and into vertical support member 242 of the U-shaped frame 212 to fix the gate extension 226 to the U-shaped frame 212.

Each of the support and adjustment members 232, 234, 236 and 238 includes a threaded shaft 282, a first hand wheel 284 fixedly engaged to threaded horizontal shaft or rod 282, and a second hand wheel 286 threadingly engaged to and spinnable on threaded horizontal shaft or rod 282.

First hand wheel 284 confronts the inner face of the end vertical support member 228 and is fixed at such location on the shaft 282. The first hand wheel 284 is rigidly mounted or fixedly engaged to the threaded horizontal shaft 282 such that a turning of the hand wheel 284 turns the shaft 282 and such that a turning of the shaft 282 rotates the first hand wheel 284. When the first hand wheel 284 is spun, the threaded horizontal shaft 282 is spun and such that, when the first hand wheel 284 is held by the hand of a user, the shaft 282 is prevented from rotating and permits second hand wheel 286 to be actuated axially and to be tightened relative to horizontal tube 274 of gate extension 226.

Second hand wheel 286 is engaged on the threaded horizontal shaft 282 such that the second hand wheel 286 travels axially on the threaded horizontal shaft 282 when spun on the threaded horizontal shaft 282. Second hand wheel 286 is confrontable with the horizontal tube 274 to space the horizontal tube 274 and thus double door gate apparatus 210 as a whole a desired distance from the end vertical support member 228.

First hand wheel 284 does not travel axially or horizontally on the shaft 282. Second hand wheel 286 travels incrementally, horizontally, longitudinally, and axially on the threaded shaft 282 in either horizontal or axial direction as hand wheel 286 is turned.

Threaded horizontal shaft or rod 282 is rotatably engaged to vertical support member 228 and such connection is removably engaged to vertical support member 228 through a threaded socket connector 279 that is received in an opening 281 formed in the rear face of the vertical support member 228.

Horizontal tube 274 includes an insert 283. Insert 283 may act as a washer to space the inner face of the second hand wheel 286 from the outer end of the horizontal tube 274. Insert 283 may have a square outer cross section such that insert 283 is not spinnable in horizontal tube 273. Insert 283 may be threaded and mate with shaft 282 such that a turning of first hand wheel 284 can draw the gate extension 226, and thus the double door gate apparatus 210 as a whole, to and away from the vertical support 228. Insert 283 may be formed of plastic. Insert 283 may not be threaded and may act as a confining receiver for shaft 282 and permitting shaft 282 to travel axially therein without mating to the shaft 282. Insert 283 is secured in the end of horizontal tube 274 and may or may not mate with threaded shaft 282. Insert 283 may have an opening that receives the threaded shaft 282 and confines movement, such as upwardly, downwardly, or side to side movement, of the threaded shaft 282.

Support and adjustment members or mechanisms 234, 236 and 238 are identical to support and adjustment member or mechanism 232.

Support and adjustment members 232 and 236 oppose the U-shaped frame 212 and its gate extensions 226 and 227 on one end, and support and adjustment members 234 and 238 oppose the U-shaped frame 212 and its gate extensions 226 and 227 on the other end so as to minimize movement of the U-shaped frame 212 and its gate extensions 226 and 227.

Mechanisms 232, 236 and mechanisms 234, 238 pinch the U-shaped frame 212 and gate extensions 226, 227 therebetween.

Shafts 282 can be rotatably fixed to the vertical posts or bases 228, 230, which then can be set up at and mounted to their desired locations. Then the second hand wheels 286 can be spun outwardly to be adjacent the vertical bases 228, 230. Then the gate extensions 226, 227 can be mounted on the shafts 282 through the horizontal tubes 274, 272, 264 and 262 and the gate extensions 226, 227 can be pushed as far as possible outwardly to be adjacent to the vertical bases 228, 230. Then one of the vertical support members or ends 242, 244 can be mounted on its respective gate extension 226, 227 with pin connectors 270. Then the U-shape frame 212 can be pulled the other way toward the unconnected gate extension 226, 227 and connected to such with pin connectors 270. Then the first and second hand wheels 284, 286 can be turned so as to pinch the U-shaped frame 212 and the gate extensions 226, 227 between the second hand wheels 286 of the four mechanisms 232, 234, 236, 238.

Vertical bases 228, 230, U-shaped frame 212, gate extensions 226, 227, main gate 214, and secondary gate 216 are disposed in a common plane when main gate 214 and secondary gate 216 are in their closed positions.

Main gate 214 includes a frame 287 having an outer end vertical support member 288, an inner end vertical support member 290, a lower horizontal support member 292, an upper horizontal support member 294 and an internal support network 296 of elongate members.

Main gate 14 slides upwardly and downwardly on a pivot member 298 running vertically from lowermost horizontal support member 240 to horizontal support member 246. Pivot member 298 may be a pin, rod, post or tubular member. Pivot member 298 may run through outer end vertical support member 288 of main gate 14. Instead of a single pivot member 298, pivot member 298 may include an upper pivot member extending downwardly from horizontal support member 246 and a lower pivot member extending upwardly from horizontal support member 240. To secure the pivot member 298 in the vertical member 288, vertical member 288 may include plastic inserts that journal the pivot member 298 therein to provide for relatively free and easy swinging of the main gate 214 about an axis of the pivot member 298. The plastic inserts also provide for relatively free and easy upward and downward sliding of the main gate 214 on the pivot member 298. The upper end of vertical support member 288 hits stop portion 252 when lifted to its fullest extent. The lower end of vertical support member 288 rests on the upper surface of horizontal support member 240 when main gate 14 is not lifted and is at a resting or closed position. Such provides more than sufficient clearance to permit catch or saddle 220 to become disengaged from lowermost horizontal support member 240 when the main gate 214 is lifted.

Lower support member 292 of the main gate 214 extends from the vertical support member 288 to the inside surface of the inner vertical support member 290 or may be integral and one-piece with the inner vertical support member 290. Lower support member 292 is spaced from lowermost horizontal support member 240 when the main gate 214 is not being lifted and when the lower end of vertical member 288 rests on the upper surface of the lowermost horizontal support member 240. The outer end of lower support member 292 is spaced from the bottom end of vertical support member 288. The inner end of lower support member 292 is adjacent to catch or saddle 220.

The inner end vertical support member 290 runs from the inner end of lower horizontal support member 292 to the underside of uppermost curved support member or handle 300. Catch or saddle 20 is adjacent to the lower end of vertical support member 290. An upper end portion of the vertical support member 290 confronts, passes by, and is engaged to the inner end of horizontal support member 294. Upper horizontal support member 294 runs from the inside of outer end vertical support member 288 to an inner face of vertical support member 290.

Figure 15:
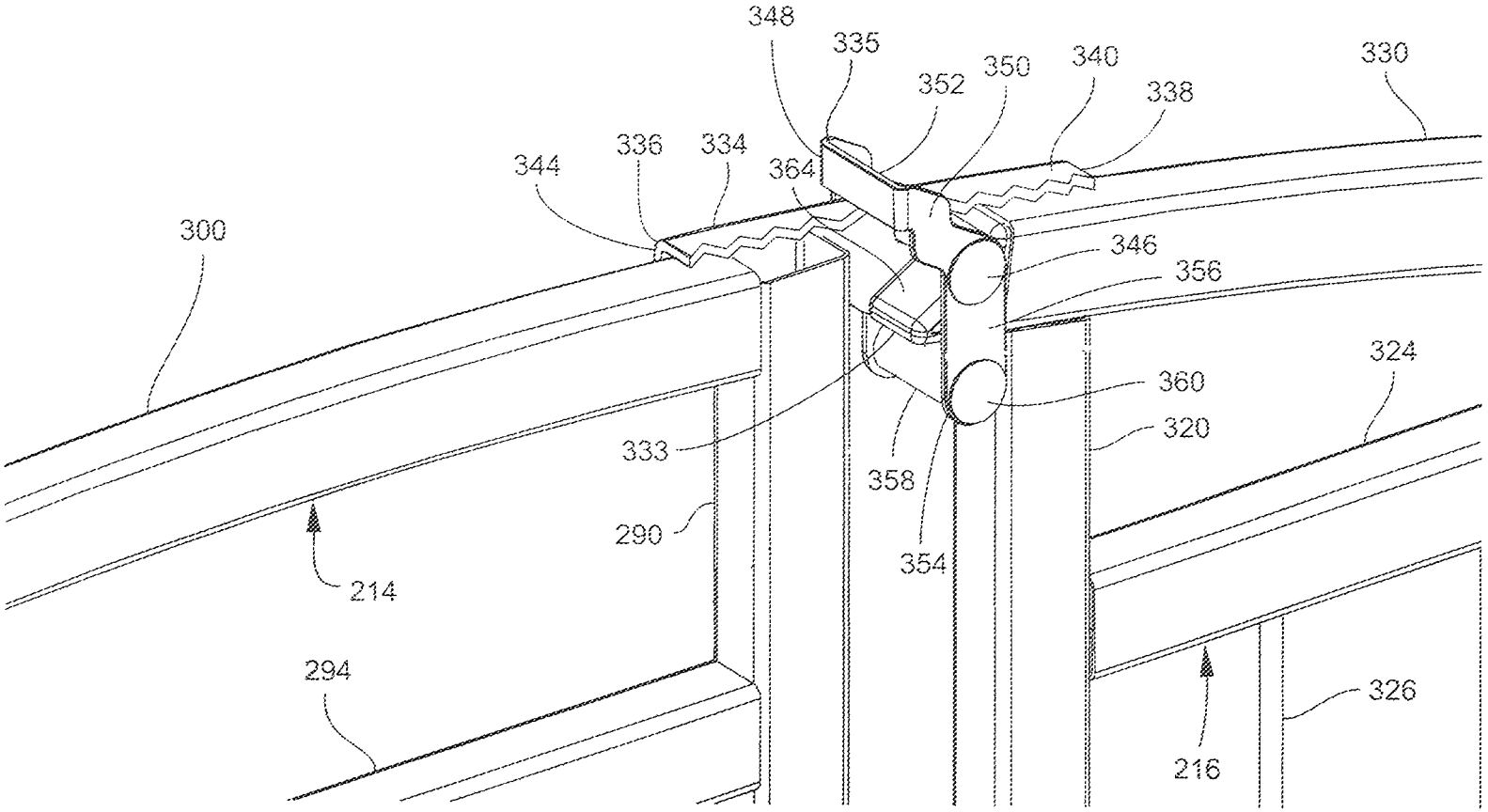
FIG. 15 shows a front perspective detail partially section view of the latch apparatus of the double door gate apparatus of FIG. 11 in a closed and locked position.

The upper end of the vertical support member 290, or specifically an outer face thereof, as shown in FIG. 15, is engaged to an inner end of the uppermost curved support member or handle 300. Inner end vertical support member 290 is spaced from the inner end of secondary gate 216.

Upper horizontal support member 294 mounts a vertically running end 301 of handle 300, which is integral with handle 300, which at the other end is engaged to the upper end of vertical support member 290. Main gate handle end 301 is mounted on upper horizontal support member 294 adjacent to and inwardly of vertical support member 288.

Main gate handle 300 may be defined to include a pair of respective outer and inner end vertical members, namely handle end 301 and a portion of inner vertical support member 290. The curved portion of handle 300 runs or extends between such end vertical members 301, 290. This curve includes a peak 105 that is not midway between the end vertical members 301, 290. The peak 305 of this curve is about midway between vertical support members 242, 244 of the U-shaped frame 212.

The support network or grid 296 is mounted between vertical members 288 and 290 and between horizontal members 292 and 294. Like with network 280, network or grid 296 may be composed of a wire grid, posts, tubes, or hollow poles. Network 296 may be welded to members 288, 290, 292 and 294.

Figure 12:
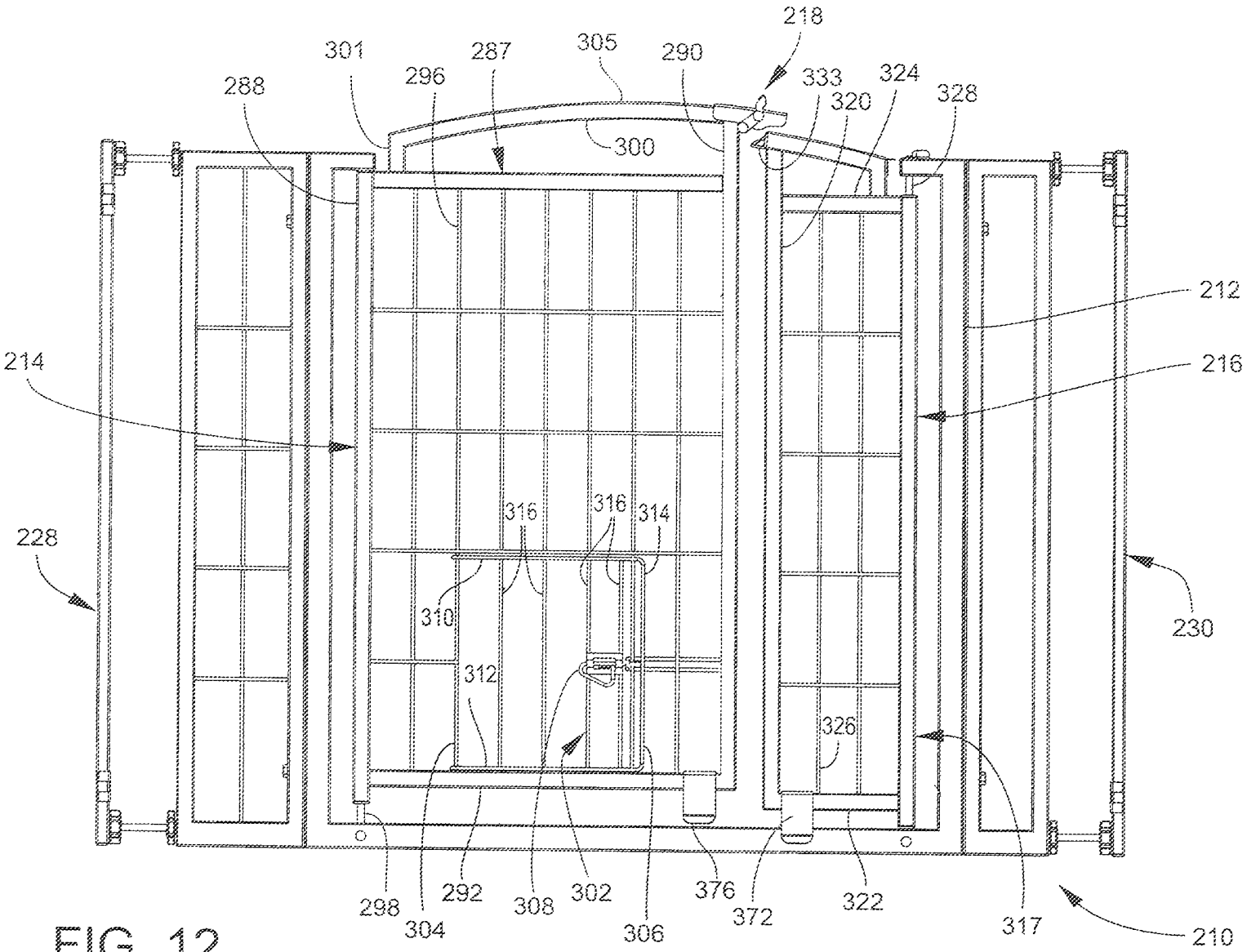
FIG. 12 shows a front elevation view of the double door gate apparatus of FIG. 11 where the swinging ends of a main gate and secondary gate are disengaged from each other, where the main gate has been disengaged from the frame of the double door gate apparatus, and where the secondary gate is in a rest or closed position.

As shown in FIGS. 11 and 12, a pet door 302 is formed in the network 296. Pet door 302 pivots on a vertically disposed support member 304 that defines an axis for a swinging of the pet door 302. Pet door 302 includes a swinging, latachable end 306. A latch mechanism 308 is disposed between the pet door 302 and the remaining portion of the network 396. Latch mechanism 308 can be hand operated from either face of the main gate 214.

Upper and lower horizontally extending members 310, 312 each have an end looped about vertical member 304 and then extend inwardly therefrom to inner end vertical support member 314. Four internal vertical support members 316 run from lower member 312 to upper member 310.

Pet door 302 can swing out to only the front face of the main gate 314.

Lower horizontal support member 312 confronts and runs adjacent to lowermost horizontal member 292 of main gate 214. Upper horizontal support member 310 confronts and runs adjacent to a horizontal support member of the main gate network 396 that extends from vertical support member 288 to vertical support member 290 of the main gate 214.

Vertical support member 314 of the pet door 302 is spaced from and adjacent to a vertical support member of the main gate network 396 that runs from horizontal support member 292 to horizontal support member 294 of the main gate 214.

Operation of the pet door 302 is independent of operation of the main gate 214. Pet door 302 can be open or closed whether main gate 214 is open or closed or in the process of being opened or closed.

Relative to a plane in which main gate 214 lies, pet door 302 can be opened from a zero degree position (i.e., a closed position in the plane of the main gate 214) to about a 179 degree position. Such opening to about a 179 degree position can be made only to the front face of the main gate 214.

The pivot connection between horizontal support member 310 of the pet door 302 and vertical support member 304 of the main gate 214 is a friction fit connection, and the pivot connection between horizontal support member 312 of the pet door 302 and vertical support member 304 of main gate 214 is a friction fit connection, such that pet door 302 can be held by such a friction fit in an open position such that the pet door 302 does not swing closed such as when main gate 214 is being opened or closed. With such a friction fit the homeowner need not repeatedly open pet door 302 for a pet such as a dog. With such a friction fit, the pet door 302 can be held at any position between the zero degree position (closed position) and the 179 degree position (most open position). With the friction fit, the homeowner can be assured that the pet door 302 remains open for the pet to come and go as the pet pleases regardless of the people-use of the main gate 214. Washers or inserts or plastic inserts between the horizontal members 310, 312 and the pivot support member 304 provide such friction fit. Pet door 302 includes no internal horizontally extending support members, with the exception of members making up the latch mechanism 308.

As shown in FIG. 11, latch mechanism 308 includes a wire piece 303 extending from vertical support member 290 toward and into the pet door 302 and slightly beyond vertical wire 314. Wire piece 303 includes a pair of parallel wires that terminate and run integrally together to form a U-shaped end that captures a straight wire latch end extending from a handle 307 of the latch mechanism 308. The U-shaped end turns forwardly at the ends of the parallel wires. Handle 307 is generally triangularly shaped except for the straight wire latch end that is captured by the U-shaped end of wire piece 303. Triangular handle 307 is hingedly engaged on a plate 311 that is mounted on adjacent wires 316. The straight wire latch end slides into the U-shaped end and over the front face of a vertically running wire of the wire network 296 of the main gate 214. When the triangular handle 307 is in a down position and in a plane adjacent to a plane defined by the pet door 302, the triangular handle 307 is blocked by the structure of the hinge plate 311 from sliding in an outward direction toward the outer end of the pet door 302. When the triangular handle 307 is turned to a substantially right angle relationship with a plane defined by the pet door 302, then the structure of the hinge plate 311 permits the triangular handle 307 to slide in such outward direction such that the straight wire latch end is slid outwardly and out of and free from engagement with the U-shaped end of wire piece 303. Then pet door 302 can be swung open. The reverse procedure is performed to close the pet door 302.

As shown in FIGS. 11 and 12, secondary gate 216 includes a frame 317 having an outer end vertical support member 318, an inner end vertical support member 320, a lower horizontal support member 322, an upper horizontal support member 324, and an internal network or grid 326 of elongate members.

Secondary gate 216 slides vertically upwardly and downwardly on a pivot member 328 running vertically from lowermost horizontal support member 240 to horizontal support member 248. Pivot member 328 may be a pin, rod, post or tubular member. Pivot member 328 may run through outer end vertical support member 318 of secondary gate 216. Instead of a single pivot member 328, pivot member 328 may include an upper pivot member extending downwardly from horizontal support member 248 and a lower pivot member extending upwardly from lowermost horizontal support member 240. To secure the pivot member 328 in the vertical member 318, vertical member 318 may include plastic inserts that journal the pivot member 328 therein to provide for relatively free and easy swinging of the secondary gate 216 about an axis of the pivot member 328. The plastic inserts also provide for relatively free and easy upward and downward sliding of the secondary gate 216 on the pivot member 328.

The upper end of vertical support member 318 hits stop portion 254 when lifted to its fullest extent. The lower end of vertical support member 318 rests on the upper surface of the lowermost horizontal support member 240 when secondary gate 216 is not lifted. Such provides more than sufficient clearance to permit catch or saddle 222 to become disengaged from lowermost horizontal support member 240 when the secondary gate 216 is lifted.

Lower support member 322 of the secondary gate 216 extends from the vertical support member 318 to the inner vertical support member 320. Lower support member 322 is spaced from lowermost horizontal support member 240 when the secondary gate 216 is not being lifted and when the lower end of vertical member 318 rests on the upper surface of the lowermost horizontal support member 240.

The outer end of lower support member 322 is spaced from the bottom end of vertical support member 318. The inner end of lower support member 322 is adjacent to catch or saddle 222. The inner end vertical support member 320 runs from the inner end of lower horizontal support member 322 and confronts, passes by and is engaged by an inner end of upper horizontal support member 324.

The upper end of the vertical support member 320 is engaged to the underside of a curved handle 330 that is mounted on horizontal support member 324 by a handle vertical end 331. Handle vertical end 331 is integral with handle 330.

Inner end vertical support member 320 is spaced from the inner end of main gate 214. Inner end vertical support member 320 is spaced from the inner end vertical support member 290 of main gate 214.

Upper horizontal support member 324 runs from the inside of outer end vertical support member 318 to an upper end portion of vertical support member 320.

Curved handle 330 is part of a framework or frame of secondary gate 216. Curved handle 300 is part of a frame or framework of main gate 214.

Curved handle 330 includes an extension 333 mounted in line with the curve of the handle 330. Curved handle 330 receives a portion of latch mechanism 218.

A secondary gate handle 330 is mounted on upper horizontal support member 324 and inner vertical support member 320. Inner vertical support member 320 may be one-piece and integral with lower horizontal support member 322.

Secondary gate handle 330 includes a pair of respective outer and inner end vertical members, namely, vertical member 320 and vertical handle end 331.

Secondary gate handle 330 curves between the upper ends of vertical member 320 and vertical handle end 331. Vertical handle end 331 is one-piece and integral with secondary gate handle 330.

The curve of secondary gate handle 330 rises in elevation from outer end vertical member 331 to inner end vertical member 320. Then, when main gate 214 and secondary gate 216 are closed, the curve of secondary gate handle 330 transitions along the same arc into the curve of main gate handle 300. Peak 305 is midway between outer end vertical member 301 of main gate handle 300 and outer end vertical member 331 of secondary gate handle 330.

Main gate handle 300 and secondary gate handle 330 are rigidly affixed to respective main gate 214 and secondary gate 216.

Members 300, 301, 290, 320, 330 and 331, that make up the handles 300, 330 are tubular and may be formed of a metal such as stainless steel or aluminum. The arc or semi-circular form provided by the curve of handles 300, 330 is associated with the locations of the main and secondary gates 214, 216 and, for example, lets the user know that there are two gates in the double door gate apparatus 210.

The support network or grid 326 is mounted between vertical members 318 and 320 and between horizontal members 322 and 324. Like with networks 280 and 296, network or grid 326 may be composed of a wire grid, posts, tubes, or hollow poles. Network 326 may be welded to members 318, 320, 322 and 324.

When neither of the main and secondary gates 214, 216 are lifted, when both of such gates 214, 216 are resting upon horizontal member 240 of the U-shaped frame 212, the axis of upper horizontal support member 294 of main gate 214 is aligned in a straight line with the axis of upper horizontal support member 324 of secondary gate 216 and, likewise, the axis of lower horizontal member 292 of main gate 214 is aligned in a straight line with the axis of lower horizontal member 322 of secondary gate 216 and, likewise, the axes of the horizontal support members of the networks 296 and 326 are aligned in straight lines.

Figure 16A:
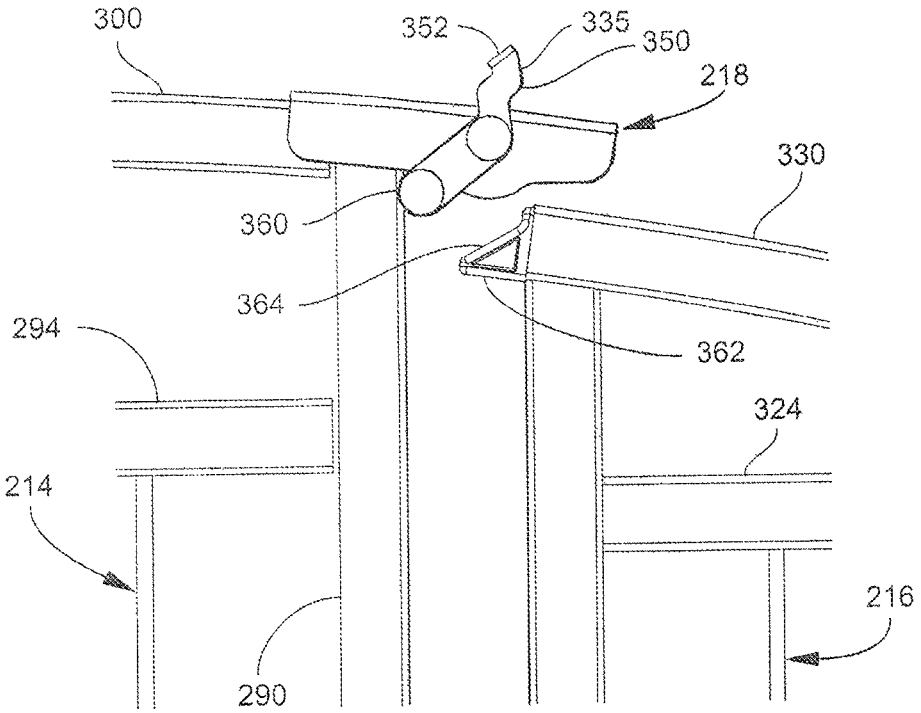
FIG. 16A shows a front perspective detail view of the latch apparatus of the double door gate apparatus of FIG. 11, where the main gate has been elevated relative to the secondary gate, where the swinging latch of the latch apparatus is in an open position and being held open against the bias of gravity, and where the U-shaped catch of the latch apparatus is positioned above the uppermost frame member of the secondary gate.
Figure 16B:
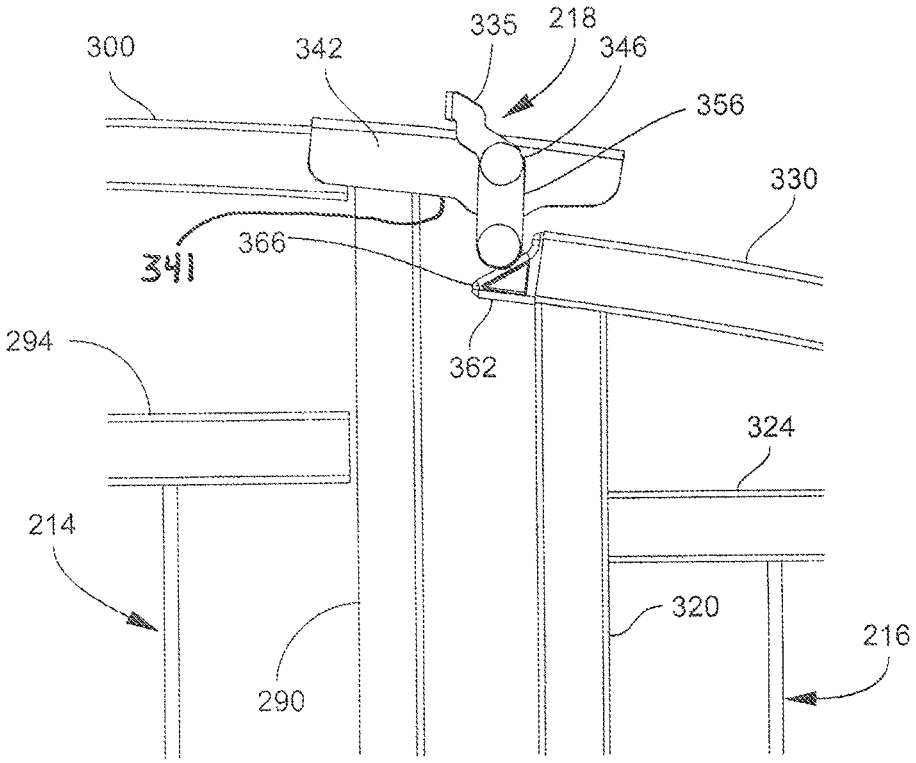
FIG. 16B shows a front perspective detail view of the latch apparatus of the double door gate apparatus of FIG. 16A, where the main gate has been elevated relative to the secondary gate, where the swinging latch of the latch apparatus has swung to a normal position under the influence of gravity, where the swinging latch is engaging the striker surface of the extension but is not yet locked under the keeper surface of the extension of the secondary gate, and where the U-shaped catch of the latch apparatus is positioned above the uppermost frame member of the secondary gate.

Latch mechanism 218 is shown in detail in FIGS. 15, 16A and 16B. Latch mechanism 218 includes a body 334, a swinging piece 335 pivotally engaged to the body 334, and the extension 333.

Body 334 is generally U-shaped from a proximal end 336 to a distal end 338. Body 334 includes a curved top plate section 340, a front plate section 342 and a rear plate section 344.

Body 334 is fixedly engaged to the junction of handle 300 and vertical support member 290. Handle 300 is a curved support member of the frame or framework of the main gate 214. Handle 300 is an uppermost support member of the main gate 214 and an uppermost support member of the double door gate apparatus 210. Body 334 engages the side faces and top face of the handle or support member 300. Body 334 engages the top open end and front and rear faces of vertical support member 290.

Body 334 extends from handle or support member 300 of main gate 214 to the handle or support member 330 of secondary gate 216. Body 334 releasably engages handle 330. Body 334 confronts handle 330 on the top face and front and rear faces. Body 334 is a keeper for the secondary gate 216 in that it keeps or prevents secondary gate 216 from swinging open or from being lifted when the latch apparatus 218 is locked. Handle or support member 330 is an uppermost support member of secondary gate 216.

Curved top plate section 340 follows the curve of handle 300 and the top face of main gate handle 300. Curved top plate section 340 follows the curve of secondary gate handle 330 and the top face of handle 330. The top faces of gate handles 300 and 330 are on the same arc and the top plate section 340 of latch apparatus 210 is also on this arc.

Swinging piece 335 is pivotally engaged to body 334 by a first pivot pin 346. Pivot pin 346 extends between the front and rear plate sections 342, 344 of body 334.

Swinging piece 335 includes an upper half piece 348 that includes a pair of actuating arms 350 and a cross piece 352. Swinging piece 335 includes a lower half piece 354 that includes a pair of follower arms 356, a roller 358, and a pivot pin 360. The weight or mass of the lower half piece 354 is greater than that weight or mass of the upper half piece 348.

The shaft of pivot pin 346 extends through the front and rear plate sections 342, 344 and further extends through the integral junctions of the actuating arms 350 and follower arms 356. Pivot pin 346 includes a front cap or head and a rear cap or head that confronts such integral junction of the arms 350, 356. Arm 350 is stepped or forms generally the shape of an S. Cross piece 352 is integral with the actuating arms 350 and extends to and between distal ends of the actuating arms 350. Cross piece 352 is spaced from the top plate section 340 when the swinging piece 335 is in the rest or closed position. Cross piece 352 is straight. Each of the actuating arms 350 and cross piece 352 is a plate section. Follower arms 356 are straight and are plate sections. Roller 358 is rotatably engaged between distal ends of the follower arms 356 by pivot pin 360, which includes a shaft engaging roller 358 and a pair of caps or heads that confront the outer faces of the distal ends of the follower arms 356. Roller 358 is cylindrical shaped. The length of roller 358 is greater than the width of extension 333.

Extension 333 may include a back plate welded to the four edges of the distal open end of support member 330. Extension 333 may be an insert plugged into or rigidly fixed in the end of handle or support member 330. Extension 333 includes a keeper face or surface 362 and a striker face or surface 364. Keeper or keeper face 362 and striker or striker face 364 form a distal end or junction 366.

Keeper face 362 is offset slightly from the horizontal. Keeper face 362 and the inner face of vertical support member 320 form an oblique angle. Keeper face 362 follows the curve of the bottom face of the handle 330. Roller 358 includes a first axis, pivot pin 346 includes a second axis, and these first and second axes lie in a first plane. This first plane traverses and intersects a second plane defined by the keeper face 362 when the swinging piece 335 is in the rest or closed position when roller 358 confronts the keeper face 362.

Striker face 364 is inclined. Striker face 364 is a ramp. Striker face 364 extends inwardly and downwardly relative to vertical support member 320. Striker face 364 and keeper face 362 form an acute angle. The proximal end of striker face 364 is at a greater elevation than the distal end or junction 366. When the roller 358 hits the striker face 364, the roller 358 is deflected down the striker face 364 to the distal end 366, whereupon under the influence of gravity roller 358 travels to or adjacent to the proximal end of the keeper face 362.

The cross piece 352 is a first end of the swinging piece 335. The cross piece 352 is adjacent to the first face 340 or top plate section 340 of the body 334 as shown in FIG. 15. The roller 358 is a second end of the swinging piece 335. Roller 358 is adjacent to lower edges of lower plate sections 342, 344 of the body 334 that define a second face 341 of the body 334, as shown in FIG. 16B. Lower plate section 342 is shown in FIG. 16B. Lower plate section 344 is shown in FIG. 15. The roller 358 swings in response to a force being applied to the cross piece 335. The cross piece 335 swings in response to a force being applied to the roller 358. Swinging piece 335 includes an open position as shown in FIG. 16A where the roller 358 has been swung beyond the distal end 366 and a closed position as shown in FIG. 15 where the roller confronts keeper 362 and is at or adjacent to the proximal end of the keeper surface 362.

Extension 333 extends from the support member 330 and towards the support member 300 when the main and secondary gates 214, 216 are closed. Extension 333 is receivable in the U-shaped body 334.

Swinging piece 335 includes an open and away position as shown in FIG. 16A. Swinging piece 335 includes a closed confronting position, relative to the extension 333, as shown in FIG. 15. The second end or roller 358 of the swinging piece 335 confronts the first or keeper surface 362 of the extension 333 when the swinging piece 335 is in the closed confronting position. In the closed confronting position the body 334 cannot be releasably engaged from support member 330 of the secondary gate 216. The second end or roller 358 of the swinging piece 335 is swingable beyond the distal end 366 of the extension 333 and in this open and away position the body 334 can be releasably engaged from the support member 330 of the secondary gate 216 to open the latch apparatus 218.

The arms 350, 356, cross piece 352, and roller 358 surround the body 334 at all times, such as when the swinging piece 335 is in the open and closed positions and is between such positions. The swinging piece 335 surrounds the body 334 and the extension 333 when the swinging piece 335 is in the closed position. Body 334 extends through the swinging piece 335 at all times. The extension 333 extends through the swinging piece 335 when the swinging piece 335 is in the closed position.

Swinging piece 335 swings about a pivot 346. A first portion of the swinging piece 335 is defined as a portion running from the pivot 346 to the first end or cross piece 352. A second portion of the swinging piece 335 is defined as a portion running from the pivot 346 to the second end or roller 358. This second portion of the swinging piece 335 has a weight greater than a weight of the first portion of the swinging piece 335 such that the second portion of the swinging piece 335 is normally disposed at a lower elevation than the first portion of the swinging piece 335. First portion is upper half piece 348. Second portion is lower half piece 354.

The first surface of the extension 333 or keeper surface 362 keeps the latch apparatus 218 locked when the swinging piece 335 is in the closed position. Pivot 346 includes a first pivot axis. This first pivot axis and pivot axis of the second end or roller 358 of the swinging piece 335 defines a first plane. This first plane intersects the first surface or keeper surface 362 when the swinging piece 335 is in a closed position.

The second surface of the extension 333 is the striker inclined surface 364 for the second end or roller 358 of the swinging piece 335. The second surface or striker surface 364 includes a proximal end at a first elevation and a distal end at a second elevation, where the first elevation is greater than the second elevation such that the second end or roller 358 of the swinging piece 335 can strike the second surface or striker surface 364 and slide down the second surface or striker surface 364.

The first and second following arms 356 extend over an exterior surface of the body 334. The first and second following arms 356 are spaced apart.

The first and second actuating arms 350 extend over exterior surfaces of the body 334. The first and second actuating arms are spaced apart by cross piece 352. A user may press or pull cross piece 352 to initiate a swinging of the swinging piece 335.

Extension 333 protrudes into the open space between main and secondary gates 214, 216. Body 334 protrudes into the open space between main and secondary gates 214, 216 and wholly traverses such an expanse. Extension 333 only partially traverses such an expanse. Extension 333 terminates short of main gate 214 when the main and secondary gates 214, 216 are closed. Roller 358 passes through a space defined by distal end 366 of extension 333 and the inner face of vertical support member 290.

Main gate 214 includes catch or saddle 220. Secondary gate 216 includes catch or saddle 222.

FIG. 11 shows saddle 220 engaged between main gate 214 and the horizontal support member 240 of the U-shaped frame 212. FIG. 11 shows saddle 222 engaged between secondary gate 216 and the horizontal support member 240 of the U-shaped frame 212.

FIG. 12 shows catch or saddle 220 disengaged from horizontal support member 240. FIG. 12 shows main gate 214 having been lifted such that the terminal bottommost ends of the catch or saddle 220 will clear the uppermost face of horizontal support member 240 when the main gate 214 is swung.

Catch or saddle 220 is U-shaped and is fixed to lower horizontal support member 292 of the main gate 214 in an inverted U-shaped fashion. Saddle 222 is U-shaped and is fixed to lower horizontal support member 322 of secondary gate 216 in an inverted U-shaped fashion.

Catch or saddle 220 includes an upper end that confronts the upper face of horizontal member 292. Catch or saddle 220 further includes a front side 368 and a rear side 370. Catch or saddle 222 includes an upper end that confronts the upper face of horizontal member 322. Catch or saddle 222 further includes a front side 372 and a rear side 374.

Each of the front and rear sides 368, 370 of catch 220 includes a flared bottom end 376. Each of the front and rear sides 372, 374 includes a flared bottom end 378.

Each of the sides 368, 370 of catch 220 confronts one of the sides of the horizontal support member 240 of the U-shaped frame 212. Each of the sides 372, 374 of catch 222 confronts one of the sides of the horizontal support member 240 of U-shaped frame 212.

Sides 368, 370 of catch 220 prevent the main gate 214 from swinging open when catch 220 is engaged to the horizontal support member 40, i.e., when the catch 220 is lowered down at least partially over the sides of the horizontal support member 240. Sides 372, 374 of catch 222 prevent the secondary gate 216 from swinging open when catch 222 is engaged to the horizontal support member 40, i.e., when the catch 222 is lowered down at least partially over the sides of the horizontal support member 240.

When the main gate 214 is lifted, the bottom edges of the flared ends 376 rise above the top surface of the horizontal support member 240 of the U-shaped frame 12, thereby permitting the main gate 214 to swing open to either of the faces of the U-shaped frame 212. When the secondary gate 216 is lifted, the bottom edges of the flared ends 378 rise above the top surface of the horizontal support member 240 of the U-shaped frame 212, thereby permitting the secondary gate 216 to swing open to either of the faces of the U-shaped frame 212.

When the main gate 214 is swung to a position where the main gate 214 is substantially in the same plane as the U-shaped frame 212, then the main gate 214 may be lowered such that once again the catch 220 engages the horizontal member 240. When the secondary gate 216 is swung to a position where the secondary gate 216 is substantially in the same plane as the U-shaped frame 212, then the secondary gate 216 may be lowered such that once again the saddle 222 engages the horizontal support member 40.

The flared ends 376 of catch 220 are spaced apart at a distance that is greater than the width of horizontal support member 240 such that main gate 214 and the horizontal support member 240 need not be perfectly aligned for the catch 220 to capture the horizontal support member 240. The flared ends 378 of catch 222 are spaced apart at a distance that is greater than the width of horizontal support member 240 such that secondary gate 216 and the horizontal support member 240 need not be perfectly aligned for the catch 222 to capture the horizontal support member 240.

Each of the flared ends 376 of catch 220 taper downwardly and outwardly from its respective flat portion of its respective side 368, 370. Each of the flared ends 378 of catch 222 taper downwardly and outwardly from its respective flat portion of its respective side 372, 374.

Each of the flat portions of sides 368, 370 of catch 220 is disposed in a plane. Each of the flat portions of sides 372, 374 of catch 222 is disposed in a plane.

Each of the flat portions of sides 368, 370 is a flat, sheet-like section and the catch 220 as a whole may be manufactured from a piece or strip of sheet metal. Each of the flat portions of sides 372, 374 is a flat, sheet-like section and the catch 222 as a whole may be manufactured from a piece or strip of sheet metal.

Catch 220 is mounted on main gate 214 on an inner end portion of the secondary gate 214. Catch 220 is mounted adjacent to the inner end vertical member 290. Catch 220 is mounted on the main gate 214 on a lower portion of the main gate 214. Catch 220 is fixed to the lower horizontal support member 292. By fixing the catch 220 at an inner portion of the main gate 214, at a relatively great distance from the pivot member 298, the main gate 214 is more stable when, for example, pressure is exerted on the closed main gate 214 in a direction crosswise to the horizontal support member 240. If the catch 220 was mounted on an outer portion close to pivot member 298 and if pressure was exerted on the main gate 214 crosswise to the horizontal support member 240, the main gate 214 may wobble or swing slightly in the direction of such pressure. By fixing the catch 220 at a lower portion of the main gate 214, the catch 220 is unobtrusive.

Catch 222 is mounted on secondary gate 216 on an inner end portion of the secondary gate 216. Saddle 222 is mounted adjacent to the inner end vertical member 320. Catch 222 is mounted on the secondary gate 216 on a lower portion of the secondary gate 216. Catch 222 is fixed to the lower horizontal support member 322. By fixing the catch 222 at an inner portion of the secondary gate 216, at a relatively great distance from the pivot member 328, the secondary gate 216 is more stable when, for example, pressure is exerted on the closed secondary gate 216 in a direction crosswise to the horizontal support member 240. If the catch 222 was mounted on an outer portion close to pivot member 328 and if pressure was exerted on the secondary gate 216 crosswise to the horizontal support member 240, the secondary gate 216 may wobble or swing slightly in the direction of such pressure. By fixing the catch or saddle 222 at a lower portion of the secondary gate 216, the catch or saddle 222 is unobtrusive.

Provided that latch mechanism 218 is open, main gate 214 and catch 220 may be lifted and disengaged from U-shaped frame 212. If latch mechanism 218 is closed, main gate 214 is prevented from being lifted and disengaged from U-shaped frame 212, unless secondary gate 216 is being lifted at the same time and unless swinging stop mechanism 224 has been swung to an out of the way position.

Provided that latch mechanism 218 is open, secondary gate 216 and catch or saddle 222 may be lifted and disengaged from U-shaped frame 212 when swinging stop mechanism 224 is swung to an out of the way position. If latch mechanism 218 is closed, secondary gate 216 can be lifted and disengaged from U-shaped frame 212 provided that swinging stop mechanism 224 has been swung to an out of the way position and provided that main gate 214 is being lifted at the same time or concurrently that the secondary gate 216 is being lifted.

Catch 220 has a relatively great amount of surface area that confronts the sides of the horizontal support member 240 of the U-shaped frame 212. This surface area extends in a direction from the outer end of the main gate 214 to the inner end of the main gate 214. In other words, the distance between one vertical edge of side 368 (or side 370) and the other vertical edge of side 368 (or side 370) is relatively great, and such distance is greater than the width of catch or saddle 220. If desired, catch or saddle 220 can run substantially continuously along the entire length of lower horizontal support member 292.

Catch 222 has a relatively great amount of surface area that confronts the sides of the horizontal support member 240 of the U-shaped frame 212. This surface area extends in a direction from the outer end of the secondary gate 216 to the inner end of the secondary gate 216. In other words, the distance between one vertical edge of side 372 (or side 374) and the other vertical edge of side 372 (or side 374) is relatively great, and such distance is greater than the width of catch or saddle 222. If desired, catch or saddle 222 can run substantially continuously along the entire length of lower horizontal support member 322.

Catch or saddle 220 confronts and is adjacent to catch or saddle 222. When main gate 214 is swung to the closed position but is not in a lifted position, catch or saddle 220 will hit the horizontal support member 240. If such occurs, then the main gate 214 is lifted, pivoted slightly to be in the plane of the U-shaped frame 212, and then set down so as to engage the catch 220 with the horizontal support member 240.

Catch or saddle 22 confronts and is adjacent to catch or saddle 220. When secondary gate 216 is swung to the closed position but is not in a lifted position, catch or saddle 222 will hit the horizontal support member 240. If such occurs, then the secondary gate 216 is lifted, pivoted slightly to be in the plane of the U-shaped frame 212, and then set down so as to engage the catch 222 with the horizontal support member 240.

Figure 17B:
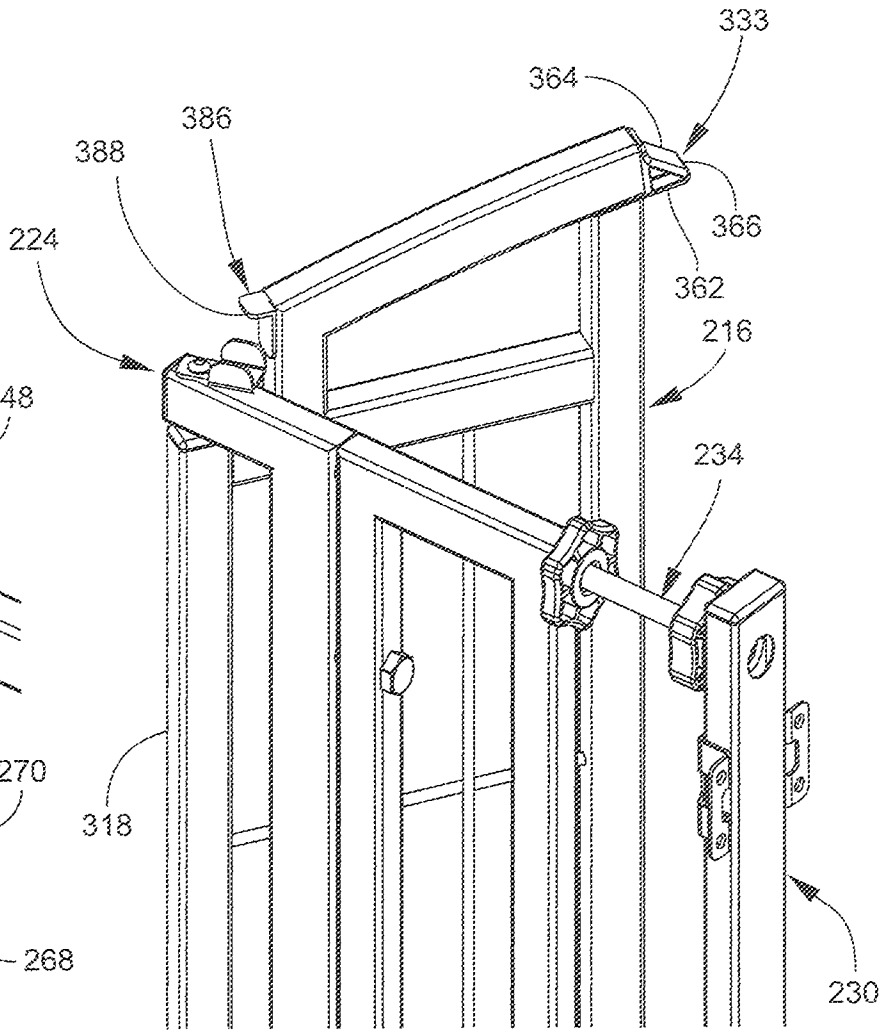
FIG. 17B is a rear perspective detail view of a portion of the secondary gate and a front perspective detail view of a portion of the frame of the double door gate apparatus of FIG. 11, shows the rear face of the extension of the secondary gate, and further shows a front perspective view of the first and second hand wheels of the double door gate apparatus of FIG. 11.
Figure 17A:
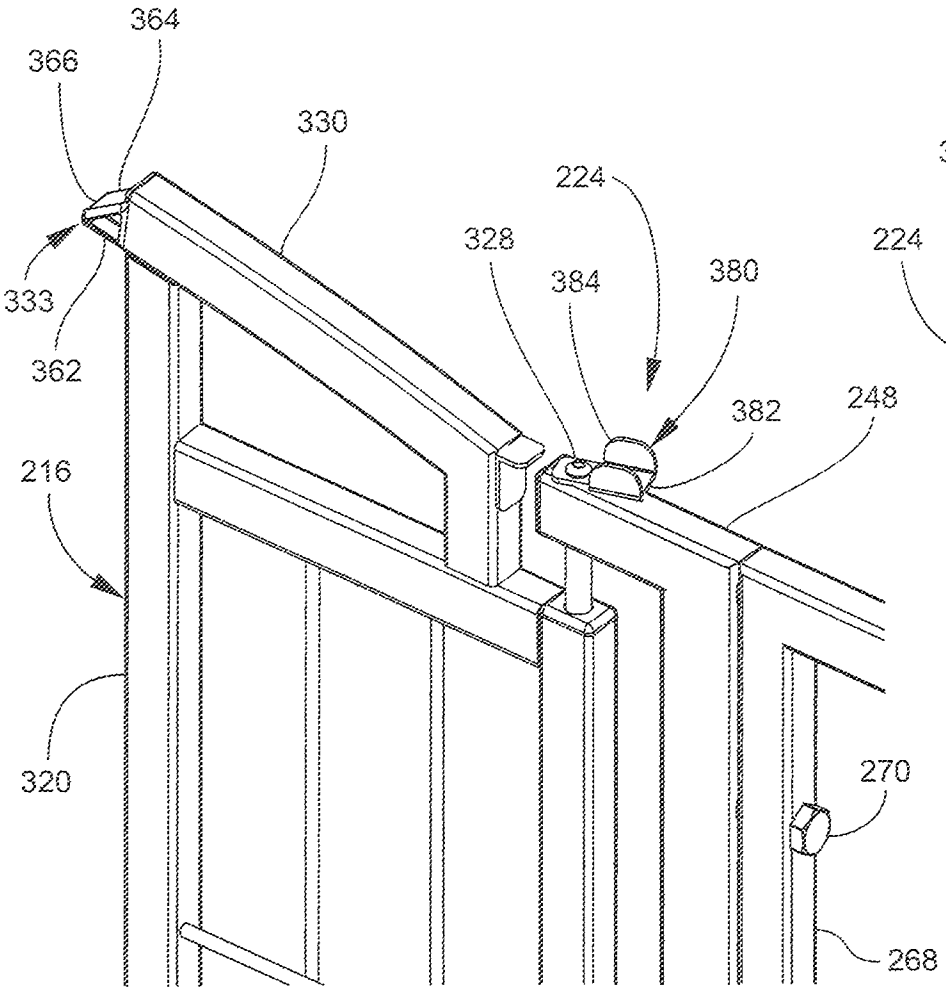
FIG. 17A is a front perspective detail view of a portion of the secondary gate and frame of the double door gate apparatus of FIG. 11, and shows the front face of the extension of the secondary gate.
Figure 18B:
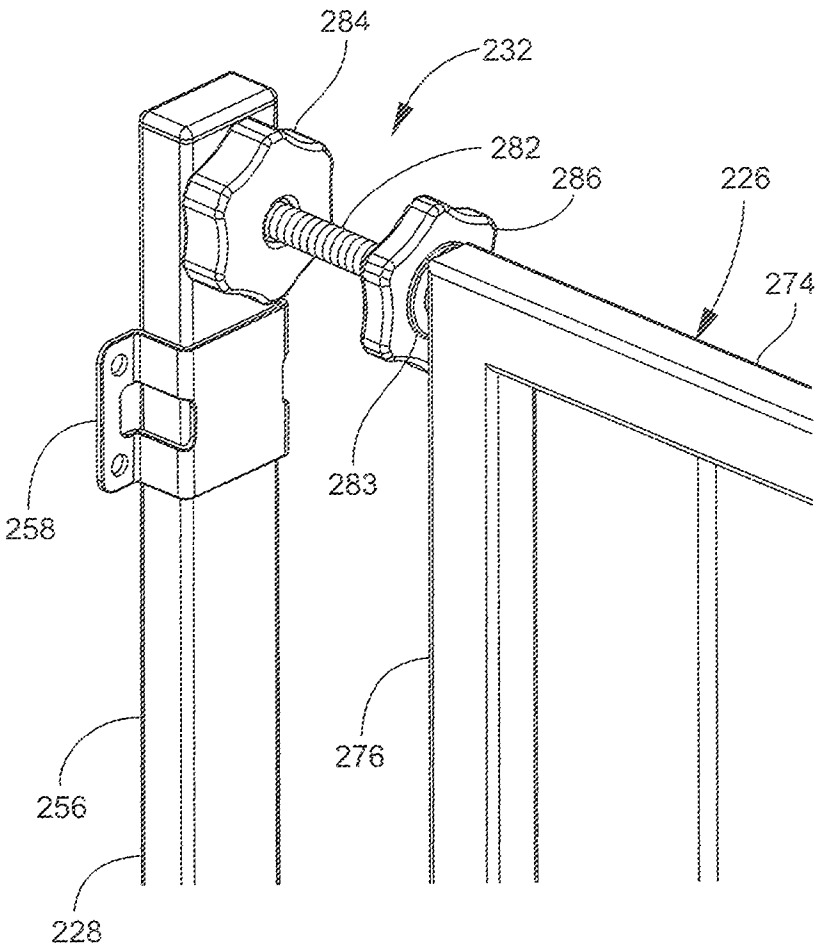
FIG. 18B is a front perspective detail view of the first and second hand wheels of the double door gate apparatus of FIG. 18A and shows portions of the front faces of the first and second hand wheels.
Figure 18A:
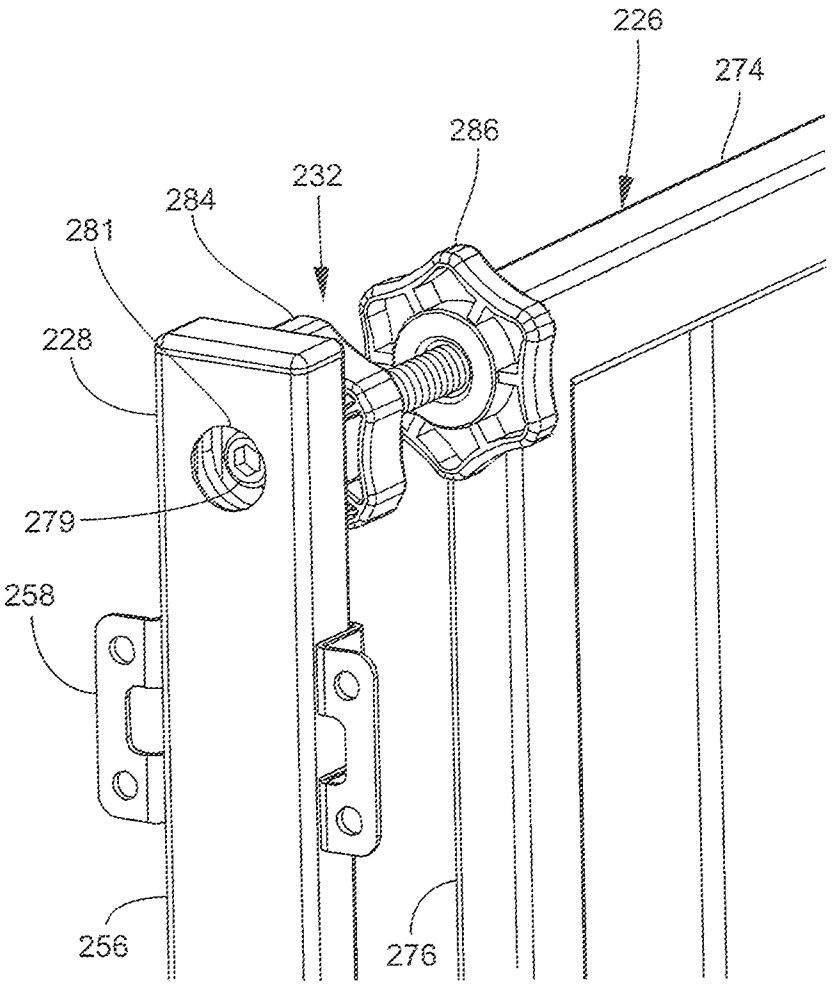
FIG. 18A is a front perspective detail view of the first and second hand wheels of the double door gate apparatus of FIG. 11 and shows portions of the rear faces of the first and second hand wheels.

FIGS. 17A and 17B show the swinging stop mechanism 224. Swinging stop mechanism 224 is mounted between the U-shaped frame 212 and the secondary gate 216. Swinging stop mechanism 224 includes a swinging stop 380 pivotally mounted to the top face of horizontal support member 248 of the U-shaped frame 212. Swinging stop 380 includes a flat strip 382 and a pair of finger tabs 384. Swinging stop mechanism 224 further includes an L-shaped piece 386 having a protruding section 388 extending into a space between secondary gate handle 330 and the inner end of horizontal support member 248. A user can swing swinging stop 380 to and beyond either of the side faces of the horizontal support member 248 or to a location directly on top of horizontal support member 248, where such location is in the plane of the U-shaped frame 212 and where, in such a location, flat strip 382 is in alignment with horizontal support member 248 and confronts from above protruding section 388 of L-shaped piece 386, thereby preventing the secondary gate 216 from being lifted, which in turn prevents the catch or saddle 222 from disengagement with the horizontal support member 240. The underside of flat piece 382 confronts the top side of protruding section 388. When the flat piece 382 is swung to an out-of-the-way position, such as shown in FIGS. 17A and 17B, protruding section 388 can be lifted upwardly beyond the horizontal support member 248, such that catch or saddle 222 can be disengaged from horizontal support member 240, such that secondary gate 216 can be swung to either side of the U-shaped frame 212. Finger tabs 384 make it easy to manipulate and push and swing the flat strip 382 to an out-of-the-way position where the secondary gate 216 may be lifted and back to the operating position where the secondary gate 216 is blocked from being lifted. L-shaped piece 386 includes a vertical base that is fixed to the outer face of handle member 331. The vertical base and the protruding section 388 are disposed at a right angle. Protruding section 388 protrudes into a space between handle 330 and U-shaped frame 212. Flat strip 382 protrudes into the space between handle 330 and U-shaped frame 212.

In operation, to install the double door gate apparatus 210, mechanisms 232, 234, 236, 238 are engaged to the vertical bases 228, 230. Then the vertical bases 228, 230 are fixed to vertical surfaces, such as to walls found in or outside of the house, to fence posts, to garage walls, or to any other inside or outside vertical surface. Brackets 258 may be employed in this step.

Then the gate extensions 226, 227 are installed on their respective vertical bases 228, 230. Then, after adjusting the distance between the gate extensions 226, 227 by manipulating the hand wheels 284, 286, the U-shaped frame 212 is engaged to and between the gate extensions 226, 227. Then the hand wheels 284, 286 can again be turned to pinch the U-shaped frame 212 between the gate extensions 226, 227.

To get through the main gate 214 only, with the secondary gate 216 remaining in a closed position where catch or saddle 220 is engaged to horizontal support member 240 and where swinging stop 224 is closed to prevent the secondary gate 216 from being lifted, a user goes through a two-step process. The first step is to open latch mechanism 218 by pushing or pulling on the cross piece 352. The second step is to lift up the main gate 214 so as to lift up the catch or saddle 220 while latch mechanism 218 is open. Then the main gate 214 may be swung open.

Horizontal support member 246 or stop 246 limits the vertical travel of main gate 214 by limiting vertical travel of the outer end vertical member 288, the upper end of which hits the underside of the horizontal support member 246. When main gate 214 is at rest with the bottom end of outer end vertical support member 288 on the horizontal support member 240, the distance between the upper end of outer end vertical support member 288 and the underside of stop or horizontal support member 246 is greater than the distance that the distal end of catch or saddle 220 travels from an engagement position to a disengagement position with horizontal support member 240.

When latch mechanism 218 is unlocked and catch or saddle 220 is free of horizontal support member 240, main gate 214 is free to be swung in either the clockwise or counter-clockwise directions, i.e., to either of the faces of the U-shaped frame 212. Then a person may walk through the main gate 214. The main gate 214 may be swung for about 179 degrees in either direction. To shut the main gate 214, the user swings the main gate 214 back to be in a common plane with the U-shaped frame 212 when the main gate 214 is in a lifted position. When in the lifted position shown in FIG. 12, catch or saddle 220 is clear of horizontal support member 240, the second end or lower end or roller 358 is clear of extension 333, body 332 is clear of extension 333 and handle 330, and swinging piece 335 is clear of extension 333 and handle 330. Then, when the main gate 214 is in the plane of the U-shaped frame 212, the main gate 214 may be lowered, whereupon the catch or saddle 220 engages horizontal support member 240 and the roller 358 strikes the striker 364, which pushes the roller 358 beyond the distal end 366, whereupon the roller 358 returns by gravity to the proximal end of the keeper 362 and to a locked position. Main gate 214 may 1) be freely swinging with minimal resistance or 2) be frictionally resistant when swung so as to remain open at a desired position, such as at 89 degrees relative to the plane of the U-shaped frame 212.

To get through the secondary gate 216 only, a user goes through a four-step process. First, the swinging stop 224 is opened by swinging the flat strip 382 to an out-of-the-way position. Second, the latch mechanism 218 is operated to disengage the latch 218 from the extension 333 of the secondary gate 216. Third, the main gate 214 is lifted and swung at least partially out of a plane defined by the U-shaped frame 212. Fourth, while the latch 218 is disengaged and the main gate 214 is swung at least partially out of the plane of the U-shaped frame 212, the secondary gate 216 is lifted to disengage catch or saddle 222 from the horizontal support member 240, whereupon secondary gate 216 can be swung. Horizontal support member 248 or stop 248 limits the vertical travel of secondary gate 216 by limiting vertical travel of the outer end vertical member 318, the upper end of which hits the underside of the horizontal support member 248. When secondary gate 216 is at rest with the bottom end of outer end vertical support member 318 on the horizontal support member 240, the distance between the upper end of outer end vertical support member 318 and the underside of stop or horizontal support member 248 is greater than the distance that the catch or saddle 222 travels from an engagement position to a disengagement position with horizontal support member 240. When swinging stop 224 is swung out-of-the-way, when latch mechanism 218 is unlatched and the main gate 214 lifted and at least partially swung open, and when catch or saddle 222 is disengaged from horizontal support member 240, secondary gate 216 is free to be swung in either the clockwise or counter-clockwise directions, i.e., to either of the faces of the U-shaped frame 212. Then a person may walk through the secondary gate 216. The secondary gate 216 may be swung for about 179 degrees in either direction. To shut the secondary gate 216, the user swings, with the main gate 214 out of the way to keep the body 334 and swinging piece 335 out of the way, the secondary gate 216 back to be adjacent to the plane of the U-shaped frame 212. Then the user lifts the secondary gate 216, aligns the catch or saddle 220 with the horizontal support member 240, and drops the secondary gate 216 into place where the catch 222 engages the horizontal support member 240. The user than lifts and swings the main gate 214 back to the plane of the U-shaped frame 212, whereupon the user lets the main gate 214 drop into the closed position. Secondary gate 216 may 1) be freely swinging with minimal resistance or 2) be frictionally resistant when swung so as to remain open at a desired position, such as at 89 degrees relative to the plane of the U-shaped frame 212.

To open the secondary gate 216 when the main gate 214 is in an open position and has already been swung out from the plane of the U-shaped frame 212, a two-step process is employed. First, the swinging stop 224 is opened by swinging the flat strip 382 to an out-of-the-way position. Second, the secondary gate 216 is lifted to disengage catch or saddle 222 from the horizontal support member 240, whereupon secondary gate 216 can be swung to an open position. With both of the main gate 214 and secondary gate 216 open to their fullest extents, a person may walk through an open area bounded by outer end vertical member 288 and outer end vertical member 318. After both of the gates 214, 216 are open, secondary gate 216 is first closed, whereupon main gate 214 may be closed.

It should be noted that the gates 214, 216 may both be lifted at the same time when engaged to each other through latch mechanism 218. Swinging stop 224 is swung to an open position, and then gates 214, 216 may be lifted together at the same time.

It should be noted that double door gate apparatus 210 is free of an intermediate vertical post or support member extending from horizontal support member 240 to be disposed between the inner ends of the main and secondary gates 214, 216. In contrast, when main and secondary gates 214, 216 are open, only free space is disposed between inner vertical support members 290, 320 of the gates 214, 216. In contrast, when main and secondary gates 214 and 216 are closed, only latch 218 extends into the space between the confronting, adjacent inner vertical support members 290, 320.

It should be noted that the double door gate apparatus 210 is free of a horizontal support member extending between the upper ends of the vertical support members 242, 244. In other words, the frame 212 is an open top frame such that no horizontal support members extend from the first vertical support member 242 to the second vertical support member 244 other than the lowermost horizontal support member 240 over which the main and secondary gates 214, 216 swing.

The double door gate apparatus 210 can include:

a) a frame 212 having a first vertical support member 242, a second vertical support member 244, the first and second vertical support members 242, 244 being spaced apart, each of the first and second vertical support members 242, 244 having an upper end and a lower end;

b) the frame 212 further having a first horizontal support member 246, a second horizontal support member 248, and a third horizontal support member 240, the first horizontal support member 246 on the upper end of the first vertical support member 242 and extending inwardly, the second horizontal support member 248 on the upper end of the second vertical support member 244 and extending inwardly, and the third horizontal support member 240 engaged to each of the lower ends of the first and second vertical support members 242, 244;

c) a main gate 214 having an outer end and an inner end, the outer end of the main gate 214 mounted on a first pivot axis between the first horizontal support member 246 and the third horizontal support member 240, the inner end of the main gate 14 swingable across the third horizontal support member 240, the main gate 214 being slideable vertically up and down on the first pivot axis;

d) a secondary gate 216 having an outer end and an inner end, the outer end of the secondary gate 216 mounted on a second pivot axis between the second horizontal support 248 member and the third horizontal support member 240, the inner end of the secondary gate 216 being swingable across the third horizontal support member 240, the secondary gate 216 being slideable vertically up and down on the second pivot axis;

e) the first and third horizontal support members 246, 240 working as stops to limit vertical sliding of the main gate 214 on the first pivot axis; and f) the second and third horizontal support members 248, 240 working as stops to limit vertical sliding of the secondary gate 216 on the second pivot axis.

The double door gate apparatus 210 can further include the main gate 214 being engagable to and disengagable from the secondary gate 216, the main gate 214 being engagable to and disengagable from the third horizontal support member 240, the secondary gate 216 being engagable to and disengagable from the third horizontal support member 240, and the secondary gate 216 being engagable to and disengagable from the second horizontal support member 248.

Figure 13:
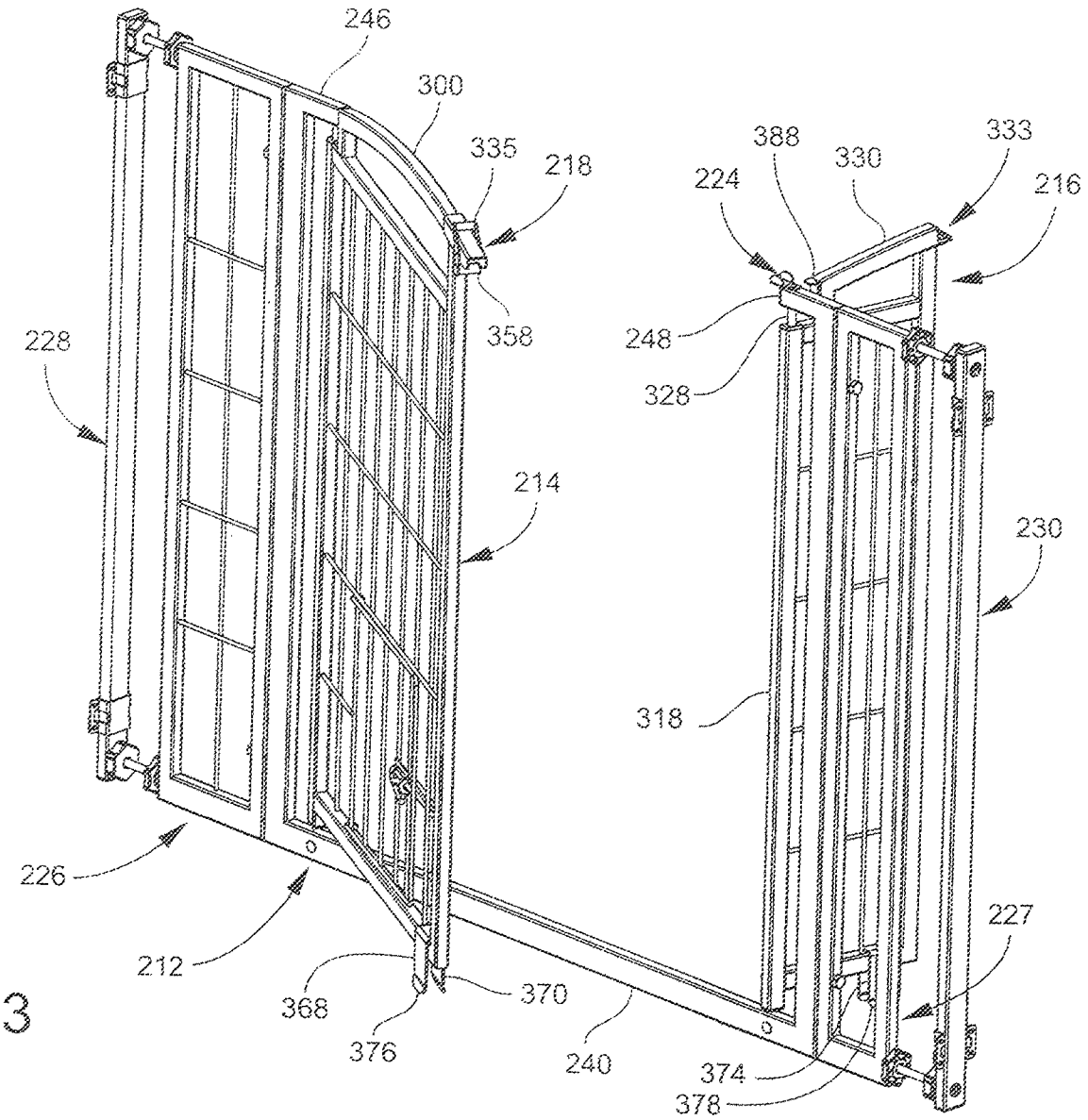
FIG. 13 shows a front perspective view of the double door gate apparatus of FIG. 11 where the swinging ends of a main gate and secondary gate are disengaged from each other, where the main gate has been disengaged from the frame of the double door gate apparatus and swung away from the bottommost horizontal support member of the double door gate apparatus, and where the secondary gate has been disengaged from the frame of the double door gate apparatus and swung away from the bottommost horizontal support member of the frame of the double door gate apparatus.
Figure 14C:
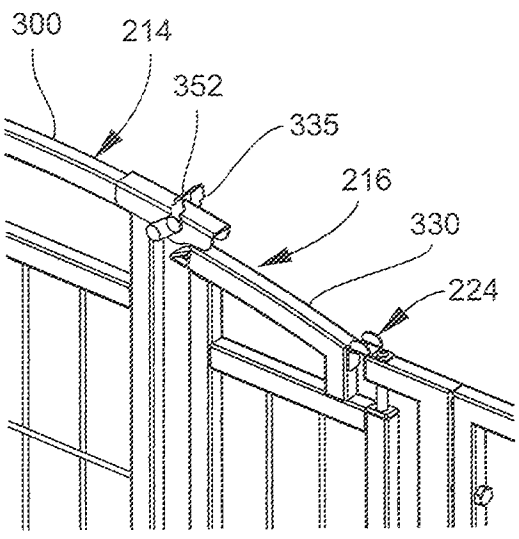
FIG. 14C shows a front perspective detail view of uppermost frame members of the main and secondary gates of the double door gate apparatus of FIG. 14A, and further shows the uppermost frame members of the main and secondary gates disengaged from each other, and further shows the latch apparatus in an unlocked and open position.
Figure 14B:
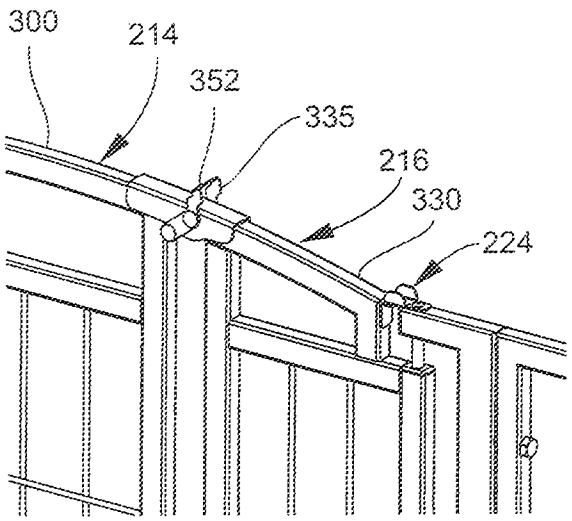
FIG. 14B shows a front perspective detail view of uppermost frame members of the main and secondary gates of the double door gate apparatus of FIG. 14A, and further shows the uppermost frame members of the main and secondary gates engaged to each other, and further shows the latch apparatus in an unlocked position ready to be opened.
Figure 14A:
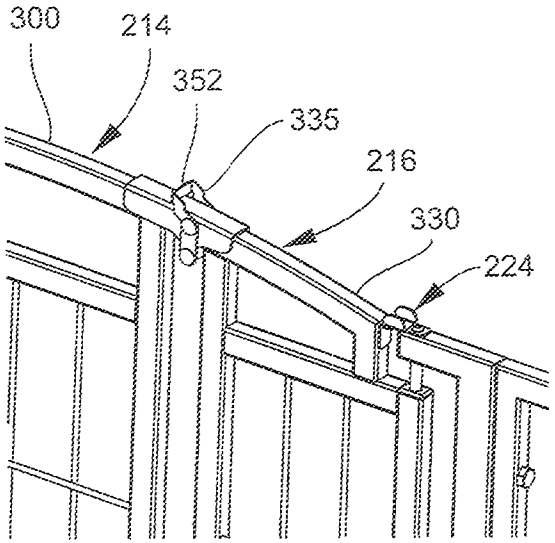
FIG. 14A shows a front perspective detail view of uppermost frame members of the main and secondary gates of the double door gate apparatus of FIG. 11, and further shows the uppermost frame members of the main and secondary gates engaged to each other, and further shows the latch apparatus in a closed and locked position.

The U-shaped frame 212 may be integral and one-piece as shown in FIGS. 11 and 12. Horizontal support member 292 and vertical support member 290 of the main gate 214 may be one-piece and integral with each other to make up a one-piece and integral L-shaped support member, as shown in FIG. 12. Horizontal support member 322 and vertical support member 320 of the secondary gate 216 may be integral and one-piece with each other to make up an L-shaped support member, as shown in FIG. 12. Support members 272, 274, 276 and 278 may be integral and one-piece with each other such that the rectangular frame of gate extension 226 may be one-piece and integral, as shown in FIG. 11. Support members 262, 264, 266, and 268 may be one-piece and integral with each other such that the rectangular frame of gate extension 227 may be one-piece and integral, as shown in FIG. 11. Tube 256 may be one-piece and integral such that the vertical support member 256 of each of the vertical bases 228, 230 is one-piece and integral, as shown in FIG. 13. Support members 300 and 301 are one-piece and integral with each other, as shown in FIG. 12. Support members 330 and 331 are one-piece and integral with each other, as shown in FIG. 11.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A double door gate apparatus comprising:

a) a frame having a first vertical support member, a second vertical support member, the first and second vertical support members being spaced apart, each of the first and second vertical support members having an upper end and a lower end;

b) the frame further having a first horizontal support member, a second horizontal support member, and a third horizontal support member, the first horizontal support member on the upper end of the first vertical support member and extending inwardly, the second horizontal support member on the upper end of the second vertical support member and extending inwardly, and the third horizontal support member engaged to each of the lower ends of the first and second vertical support members;

c) a main gate having an outer end and an inner end, the outer end of the main gate mounted on a first pivot axis between the first horizontal support member and the third horizontal support member, the inner end of the main gate swingable across the third horizontal support member, the main gate being slideable vertically up and down on the first pivot axis;

d) a secondary gate having an outer end and an inner end, the outer end of the secondary gate mounted on a second pivot axis between the second horizontal support member and the third horizontal support member, the inner end of the secondary gate being swingable across the third horizontal support member, the secondary gate being slideable vertically up and down on the second pivot axis;

e) the first and third horizontal support members working as stops to limit vertical sliding of the main gate on the first pivot axis;

f) the second and third horizontal support members working as stops to limit vertical sliding of the secondary gate on the second pivot axis;

g) wherein the first horizontal support member works as a stop to limit upward vertical sliding of the main gate on the first pivot axis;

h) wherein the second horizontal support member works as a stop to limit upward vertical sliding of the secondary gate on the second pivot axis;

i) wherein the main gate is engagable to and disengagable from the secondary gate, wherein the main gate is engagable to and disengagable from the third horizontal support member, wherein the secondary gate is engagable to and disengagable from the third horizontal support member, and wherein the secondary gate is engagable to and disengagable from the second horizontal support member by a swinging stop engaged between the secondary gate and the second horizontal support member; and j) wherein a portion of the second horizontal support member works as a fixed stop against a portion of the secondary gate after the secondary gate is disengaged from the swinging stop of the second horizontal support member.

* * * * *